US010483029B2

(12) United States Patent
Inaba

(10) Patent No.: US 10,483,029 B2
(45) Date of Patent: Nov. 19, 2019

(54) CORE MEMBER, REACTOR, AND METHOD FOR MANUFACTURING CORE MEMBER

(71) Applicants: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

(72) Inventor: Kazuhiro Inaba, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

( * ) Notice: Subject to any disclaimer, the term of this patent is extended or adjusted under 35 U.S.C. 154(b) by 54 days.

(21) Appl. No.: 15/321,169

(22) PCT Filed: Jun. 22, 2015

(86) PCT No.: PCT/JP2015/067930
§ 371 (c)(1),
(2) Date: Dec. 21, 2016

(87) PCT Pub. No.: WO2015/199044
PCT Pub. Date: Dec. 30, 2015

(65) Prior Publication Data

US 2017/0154719 A1 Jun. 1, 2017

(30) Foreign Application Priority Data

Jun. 24, 2014 (JP) ..... 2014-129269

(51) Int. Cl.
*H01F 27/24* (2006.01)
*H01F 27/255* (2006.01)
(Continued)

(52) U.S. Cl.
CPC ..... *H01F 27/255* (2013.01); *H01F 3/08* (2013.01); *H01F 3/10* (2013.01); *H01F 27/24* (2013.01);
(Continued)

(58) Field of Classification Search
CPC ..... H01F 27/00–36
(Continued)

(56) References Cited

U.S. PATENT DOCUMENTS

2010/0171580 A1* 7/2010 Abe ..... H01F 3/14 336/178
2017/0154719 A1* 6/2017 Inaba ..... H01F 27/255

FOREIGN PATENT DOCUMENTS

JP 11121262 A 4/1999
JP 2004128455 A 4/2004
(Continued)

*Primary Examiner* — Tuyen T Nguyen
(74) *Attorney, Agent, or Firm* — Honigman LLP

(57) ABSTRACT

A core member capable of favorably meeting required characteristics is provided. A core member according to the present invention is obtained by molding a mixture containing soft magnetic powder and a resin. This core member includes a specific portion including, as a specific surface, at least one of an installation surface facing an object on which the core member is to be installed and an interlinkage surface that is intersected by a magnetic flux excited by a coil, and an opposite surface on a side opposite to the specific surface. The specific portion has a higher density than a region of the opposite surface.

11 Claims, 11 Drawing Sheets

(51) Int. Cl.

| | |
|---|---|
| ***H01F 37/00*** | (2006.01) |
| ***H01F 3/08*** | (2006.01) |
| ***H01F 3/10*** | (2006.01) |
| ***H01F 27/28*** | (2006.01) |
| ***H01F 41/02*** | (2006.01) |

(52) U.S. Cl.
CPC ..... *H01F 27/2823* (2013.01); *H01F 37/00* (2013.01); *H01F 41/0246* (2013.01); *H01F 2003/106* (2013.01)

(58) Field of Classification Search
USPC ..... 336/65, 83, 90, 92, 96, 212, 220–223, 336/233–234
See application file for complete search history.

(56) References Cited

FOREIGN PATENT DOCUMENTS

| | | | |
|---|---|---|---|
| JP | 2009033057 | A | 2/2009 |
| JP | 2011228456 | A | 11/2011 |
| JP | 2012019087 | A | 1/2012 |
| JP | 2013118352 | A | 6/2013 |
| WO | 2014196400 | A1 | 12/2014 |

* cited by examiner

CORE MEMBER, REACTOR, AND METHOD FOR MANUFACTURING CORE MEMBER

CROSS-REFERENCE TO RELATED APPLICATIONS

This application is the U.S. national stage of PCT/JP2015/067930 filed Jun. 22, 2015, which claims priority of Japanese Patent Application No. JP 2014-129269 filed on Jun. 24, 2014.

FIELD

The present invention relates to a core member obtained by filling a mold with a mixture containing soft magnetic powder and a resin through a gate and solidifying the resin, a reactor provided with the core member, and a manufacturing method for manufacturing the core member. In particular, the present invention relates to a core member capable of favorably meeting required characteristics.

BACKGROUND

A reactor is one of the parts used in a circuit that boosts/lowers a voltage. Reactors are used in converters to be mounted in vehicles such as hybrid cars. The reactor disclosed in JP 2013-118352A is an example of such reactors.

The reactor disclosed in JP 2013-118352A includes a coil and a magnetic core (core member) made of a composite material containing magnetic powder and a resin (paragraphs 0105 to 0116 in the specification). This magnetic core is manufactured by filling a mold with a mixture containing the magnetic powder and an unsolidified (uncured) resin and curing the resin.

Examples of characteristics required for a magnetic member such as a reactor includes a heat dissipating characteristic and a magnetic characteristic, and the further improvement of these required characteristics are in demand. In particular, a technique for improving the heat dissipating characteristic and the magnetic characteristic by enhancing the configuration of the magnetic core has not been examined sufficiently.

The present invention has been achieved in light of the aforementioned circumstances, and an object thereof is to provide a core member capable of favorably meeting the characteristics required for a magnetic member.

Another object of the present invention is to provide a reactor provided with the above-mentioned core member.

Yet another object of the present invention is to provide a method for manufacturing a core member that is used to manufacture the above-mentioned core member.

SUMMARY OF THE INVENTION

A core member according to an aspect of the present invention is obtained by molding a mixture containing soft magnetic powder and a resin. This core member includes a specific portion including, as a specific surface, at least one of an installation surface facing an object on which the core member is to be installed and an interlinkage surface that is intersected by a magnetic flux excited by a coil, and an opposite surface on a side opposite to the specific surface. The specific portion has a higher density than a region of the opposite surface.

A reactor according to an aspect of the present invention includes a coil obtained by winding a winding wire and a magnetic core in which the coil is arranged. At least a portion of the magnetic core is constituted by the above-mentioned core member.

A method for manufacturing a core member according to an aspect of the present invention includes a step of molding a core member by injecting a mixture containing soft magnetic powder and a resin into a mold through a gate and curing the resin. The mold includes a specific inner peripheral surface for molding a specific surface including at least one of an installation surface facing an object on which the core member is to be installed and an interlinkage surface that is intersected by a magnetic flux excited by a coil, out of the surfaces of the core member, and an opposite inner peripheral surface for molding an opposite surface on a side opposite to the specific surface. The gate is located close to the opposite inner peripheral surface rather than the specific inner peripheral surface in the mold.

The above-mentioned core member is capable of favorably meeting characteristics required for a magnetic member.

The above-mentioned reactor has excellent required characteristics.

The above-mentioned method for manufacturing a core member can be used to manufacture a core member capable of favorably meeting required characteristics.

DETAILED DESCRIPTION OF THE PREFERRED EMBODIMENTS

Figure 1:
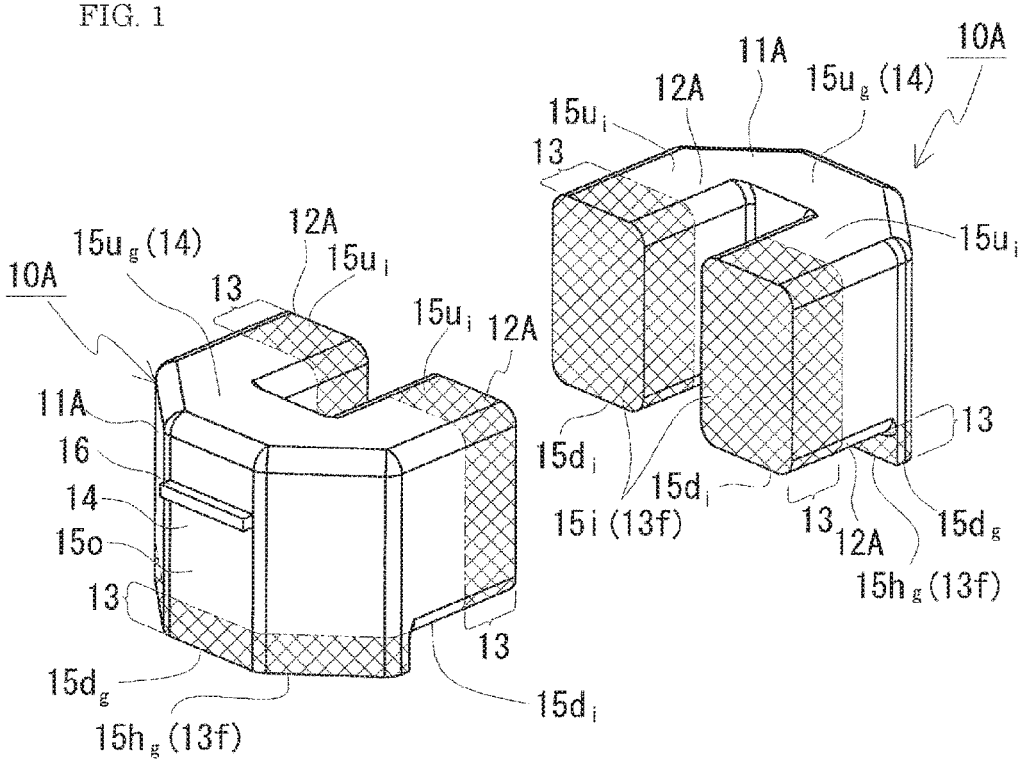
FIG. 1 shows diagrams of a core member according to Embodiment 1. The left diagram is a schematic perspective view as viewed from the outer end surface side, and the right diagram is a schematic perspective view as viewed from the interlinkage surface side.

First, details of embodiments of the present invention are listed and explained.

(1) A core member according to an embodiment is obtained by molding a mixture containing soft magnetic powder and a resin. This core member includes a specific portion including, as a specific surface, at least one of an installation surface facing an object on which the core member is to be installed and an interlinkage surface that is intersected by a magnetic flux excited by a coil, and an opposite surface on a side opposite to the specific surface. The specific portion has a higher density than a region of the opposite surface.

With the above-mentioned configuration, required characteristics can be favorably met. The reason for this is that when the specific portion includes the installation surface as the specific surface, the installation surface side contains a larger amount of soft magnetic powder, thus making it possible to enhance the thermal conductivity and improve the heat dissipating characteristic of the core member via the installation surface. In addition, the reason is that when the specific portion includes the interlinkage surface as the specific surface, the interlinkage surface side contains a larger amount of soft magnetic powder, thus making it possible to enhance the magnetic permeability and reduce a leakage magnetic flux on the interlinkage surface to improve the magnetic characteristic of the core member. When the specific portion includes both the installation surface and the interlinkage surface as the specific surface, both the heat dissipating characteristic and the magnetic characteristic can be improved.

(2) A core member according to an aspect of the above-mentioned core member is molded by injecting the mixture into a mold through a gate and includes a gate trace portion located close to the opposite surface rather than the specific surface on the outer surface of the core member. The specific portion has a higher density than a region of the trace portion.

With the above-mentioned configuration, the gate trace portion is located close to the opposite surface rather than the specific surface, and thus the gate trace portion is formed at a position away from the specific portion. Therefore, the density of the specific portion can be increased.

The core member is manufactured by filling the cavity of the mold with the above-mentioned mixture through the gate and then solidifying (curing) the resin as mentioned above, but conventionally, the relationship between the improvement of characteristics required for the core member and the position of the gate during molding has not been examined. In order to improve the characteristics required for the magnetic member, the inventors of the present invention analyzed the core member manufactured by molding the above-mentioned mixture injected into the mold through the gate, and thus the following findings were obtained. The above-mentioned effects are based on these findings.

(a) Respective portions of the core member differ in density.

(b) Out of the portions of the core member, a portion located away from the gate tends to have a higher density.

(c) It is preferable that the filling factor of the soft magnetic powder is high and the density is high from the viewpoint of improving the heat dissipating property and reducing the leakage magnetic flux.

(d) When a position at which specific characteristics as the magnetic member, such as an improved heat dissipating property and reduced leakage magnetic flux, are required is located away from the gate, the density of the position at which the aforementioned characteristics are required can be increased.

(3) In a core member according to an aspect of the above-mentioned core member including the trace portion, the specific surface includes the installation surface, and the trace portion is formed on an outer end surface connecting the installation surface and an opposite surface of the installation surface.

With the above-mentioned configuration, the trace portion is formed on the outer end surface connecting the installation surface and the opposite surface of the installation surface, and therefore, the density of the end portion on the installation surface side of the core member including the installation surface can be increased, thus making it possible to improve the heat dissipating characteristic of the core member.

(4) In a core member according to an aspect of the above-mentioned core member including the trace portion, the specific surface includes the interlinkage surface, and the trace portion is formed on the opposite surface of the interlinkage surface.

With the above-mentioned configuration, the trace portion is formed on the opposite surface of the interlinkage surface, and therefore, the density of the end portion on the interlinkage surface side of the core member including the interlinkage surface can be increased, thus making it possible to improve the magnetic characteristic of the core member.

(5) A core member according to an aspect of the above-mentioned core member including the trace portion includes a base portion and a pair of projecting portions. The base portion includes the installation surface, the opposite surface of the installation surface, and the outer end surface connecting the installation surface and the opposite surface of the installation surface. The projecting portion includes the interlinkage surface on a side opposite to the outer end surface, projects from the base portion in a direction parallel to the installation surface, and is inserted into the coil. In this case, it is preferable that the trace portion is formed on the opposite surface side of the outer end surface.

With the above-mentioned configuration, the trace portion is formed on the opposite surface side of the outer end surface, and therefore, the density of the end portion on the interlinkage surface side including the interlinkage surface and the density of the end portion on the installation surface side including the installation surface can be increased, thus making it possible to improve the magnetic characteristic and the heat dissipating characteristic.

(6) A core member according to an aspect of the above-mentioned core member including the trace portion includes a base portion, an inner projecting portion and outer projecting portions. The base portion includes the installation surface, the opposite surface of the installation surface, and the outer end surface connecting the installation surface and the opposite surface of the installation surface. The inner projecting portion includes the interlinkage surface on a side opposite to the outer end surface, projects from the base portion in a direction parallel to the installation surface, and is inserted into the coil. The outer projecting portions project from the base portion in the direction parallel to the installation surface on an outer periphery of the coil while the inner projecting portion is located between the outer projecting portions. In this case, it is preferable that the trace portion is formed on the opposite surface side of the outer end surface.

With the above-mentioned configuration, the trace portion is formed on the opposite surface side of the outer end surface, and therefore, the density of the end portion on the interlinkage surface side including the interlinkage surface and the density of the end portion on the installation surface side including the installation surface can be increased, thus making it possible to improve the magnetic characteristic and the heat dissipating characteristic.

(7) A core member according to an aspect of the above-mentioned core member including the trace portion includes the outer end surface connecting the installation surface and the opposite surface of the installation surface, and the trace portion is formed on the opposite surface side of the outer end surface with respect to a position at which a distance from the installation surface is ⅔ of a distance between the installation surface and the opposite surface.

With the above-mentioned configuration, as the distance from the gate increases, the density can be further increased, and therefore, the density of the specific portion can be further increased by forming the trace portion at the above-mentioned position.

(8) A reactor according to an embodiment includes a coil obtained by winding a winding wire and a magnetic core in which the coil is arranged. At least a portion of the magnetic core is constituted by the core member according to any one of (1) to (7) above.

With the above-mentioned configuration, the reactor includes the above-described core member, and thus has the excellent required characteristics such as the magnetic characteristic and the heat dissipating characteristic.

(9) A method for manufacturing a core member according to an embodiment includes a step of molding a core member by injecting a mixture containing soft magnetic powder and a resin into a mold through a gate and curing the resin. The mold includes a specific inner peripheral surface for molding a specific surface including at least one of an installation surface facing an object on which the core member is to be installed and an interlinkage surface that intersected by a magnetic flux excited by a coil, out of the surfaces of the core member, and an opposite inner peripheral surface for molding an opposite surface on a side opposite to the specific surface. The gate is located close to the opposite inner peripheral surface rather than the specific inner peripheral surface in the mold.

With the above-mentioned configuration, a core member capable of favorably meeting required characteristics can be manufactured. The reason for this is that the density of the specific portion including the specific surface can be increased by locating the gate at a position away from the specific portion in the mold as described above.

(10) In a method for manufacturing a core member according to an aspect of the above-mentioned manufacturing method, the core member includes the installation surface, an opposite surface of the installation surface, and an outer end surface connecting the installation surface and the opposite surface of the installation surface, and the gate is provided at a position corresponding to the outer end surface.

With the above-mentioned configuration, a core member can be manufactured in which the installation surface side contains a larger amount of soft magnetic powder, the thermal conductivity of the installation surface can be enhanced, and the heat dissipating characteristic is excellent.

(11) In a method for manufacturing a core member according to an aspect of the above-mentioned manufacturing method, the core member includes the interlinkage surface and the opposite surface of the interlinkage surface, and the gate is provided at a position corresponding to the opposite surface of the interlinkage surface.

With the above-mentioned configuration, a core member can be manufactured in which the interlinkage surface side contains a larger amount of soft magnetic powder, a leakage magnetic flux can be reduced on the interlinkage surface, and the magnetic characteristic is excellent.

(12) In a method for manufacturing a core member according to an aspect of the above-mentioned manufacturing method, the core member includes a base portion and a pair of projecting portions, and the gate is provided at a position corresponding to the opposite surface side of an outer end surface of the base portion. The base portion includes the installation surface, the opposite surface of the installation surface, and the outer end surface connecting the installation surface and the opposite surface of the installation surface. The pair of projecting portions includes the interlinkage surface on a side opposite to the outer end surface, projects from the base portion in a direction parallel to the installation surface, and is inserted into the coil.

With the above-mentioned configuration, the density of the end portion on the interlinkage surface side including the interlinkage surface and the density of the end portion on the installation surface side including the installation surface can be increased, and a core member having an excellent magnetic characteristic and heat dissipating characteristic can be manufactured.

(13) In a method for manufacturing a core member according to an aspect of the above-mentioned manufacturing method, the core member includes a base portion, an inner projecting portion and a pair of outer projecting portions, and the gate is provided at a position corresponding to the opposite surface side of an outer end surface of the base portion. The base portion includes the installation surface, the opposite surface of the installation surface, and the outer end surface connecting the installation surface and the opposite surface of the installation surface. The inner projecting portion includes the interlinkage surface on a side opposite to the outer end surface, projects from the base portion in a direction parallel to the installation surface, and is inserted into the coil. The pair of outer projecting portions projects from the base portion in the direction parallel to the installation surface on an outer periphery of the coil while the inner projecting portion is located between the outer projecting portions.

With the above-mentioned configuration, the density of the end portion on the interlinkage surface side including the interlinkage surface and the density of the end portion on the installation surface side including the installation surface can be increased, and a core member having an excellent magnetic characteristic and heat dissipating characteristic can be manufactured.

(14) In a method for manufacturing a core member according to an aspect of the above-mentioned manufacturing method, the core member includes the installation surface, the opposite surface of the installation surface, and the outer end surface connecting the installation surface and the opposite surface of the installation surface, and the gate is provided at a position corresponding to the opposite surface side of the outer end surface with respect to a position at which a distance from the installation surface is ⅔ of a distance between the installation surface and the opposite surface.

With the above-mentioned configuration, a core member in which the specific portion has an even higher density can be manufactured.

Hereinafter, details of embodiments of the present invention will be described with reference to the drawings. It should be noted that the present invention is not limited to these embodiments and is defined by the scope of the appended claims, and all changes that fall within the same essential spirit as the scope of the claims are intended to be included therein.

Embodiment 1

Core Member

A core member according to the embodiment is made of a composite material containing soft magnetic powder and a resin. This core member is obtained by solidifying (curing) the resin in a mixture containing the soft magnetic powder and the resin, and typically constitutes at least a portion of a magnetic core provided in a reactor. Although details will be specifically described later, the reactor includes a coil 2A and a magnetic core 1A shown in FIG. 2, for example. The coil 2A is obtained by connecting in parallel a pair of wound portions 20*a* and 20*b* that are each obtained by spirally winding a winding wire 20*w*. The magnetic core 1A is configured to have an annular shape by combining two core members 10A having the same shape. Here, both of the core members 10A are made of the composite material. The core member 10A is manufactured by filling a cavity of a mold with constituent materials in a fluid state through a gate and solidifying the resin. The core member 10A is mainly characterized by including a specific portion in which a heat dissipating characteristic, a magnetic characteristic, and the like are required, the specific portion having a higher density than a region of an opposite surface of the specific portion. Here, an aspect will be described in which the gate is arranged such that the specific portion has a higher density than a region of the opposite surface of the specific portion, and the specific portion and a gate trace portion satisfy a specific positional relationship. Hereinafter, the core member will be specifically described with reference to mainly FIG. 1. Here, a reactor 100A is built by assembling the core members 10A to the coil 2A, and when the reactor 100A is installed on an installation target such as a cooling base, the installation target side is referred to as "lower side", a side opposite to the installation target is referred to as "upper side", and the vertical direction is referred to as "height direction", in the following description. In the figures, components having the same name are denoted by the same reference numeral.

Overall Configuration

Figure 2:
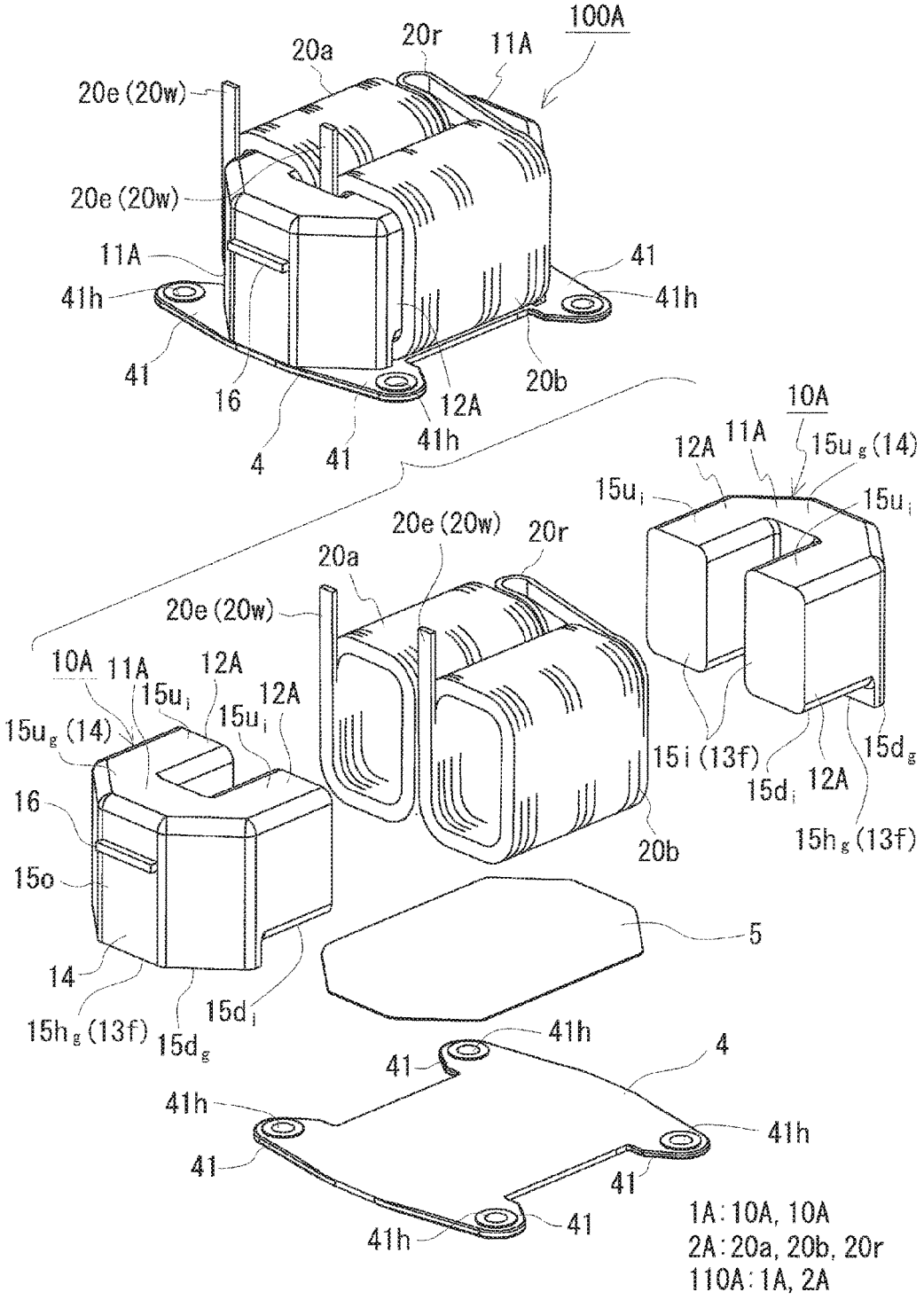
FIG. 2 shows diagrams of a reactor according to Embodiment 1. The upper diagram is a schematic perspective view, and the lower diagram is an exploded perspective view.

The core member 10A includes a base portion 11A and a pair of projecting portions 12A projecting from one end surface of the base portion 11A. The core member 10A is substantially U-shaped, as viewed from above. When the core member 10A is assembled to the coil 2A (FIG. 2), the base portion 11A projects from the end surface of the coil 2A. The base portion 11A includes a lower surface 15$d_g$, an upper surface 15$u_g$, and an outer end surface 15*o* (surface on a side opposite to the projecting portions 12A) connecting the lower surface 15$d_g$ and the upper surface 15$u_g$. The outer end surface 15*o* includes a planar portion that is parallel to interlinkage surfaces 15*i* (described later) of the projecting portions 12A and is located at the center, and oblique portions that are arranged on both sides of the planar portion. The base portion 11A has substantially a trapezoidal columnar shape. The projecting portions 12A project from the base portion 11A in a direction parallel to the lower surface 15$d_g$ and in a direction away from the outer end surface 15*o* and are inserted into the coil 2A when the core member 10A is assembled to the coil 2A. The projecting portions 12A each have the interlinkage surface 15*i*, which is on a side opposite to the outer end surface 15*o* of the base portion 11A and which is intersected by a magnetic flux excited by the coil 2A. The projecting portions 12A have a rectangular parallelepiped shape, and their corner portions are rounded off so as to fit the inner peripheral surfaces of the wound portions 20*a* and 20*b* (FIG. 2).

The upper surface 15$u_g$ of the base portion 11A is flush with upper surfaces 15$u_i$ of the two projecting portions 12A, but the lower surface 15$d_g$ of the base portion 11A is lower than lower surfaces 15$d_i$ of the two projecting portions 12A. When the core member 10A is assembled to the coil 2A, the lower surface 15$d_g$ of the base portion 11A is flush with the lower surface of the coil 2A. That is, the surface of the core member 10A on the installation target side is constituted by the lower surface 15$d_g$ of the base portion 11A, and this lower surface 15$d_g$ forms an installation surface 15$h_g$ serving as a heat dissipating path of the core member 10A. The lengths of the projecting portions 12A (lengths from the base portion 11A in the projecting direction) are about half of the lengths of the wound portions 20*a* and 20*b*.

Specific Portion

A specific portion 13 is a portion of the core member 10A in which specific characteristics are more remarkably required than in other portions when the core member 10A is used as a magnetic core. Specific examples of the required characteristics include a heat dissipating characteristic and a magnetic characteristic. In FIG. 1, the specific portion 13 is crosshatched. In order to meet the required characteristics such as the heat dissipating characteristic and the magnetic characteristic, the specific portion 13 includes at least one of the installation surface 15$h_g$ and the interlinkage surfaces 15*i*, for example, as a specific surface 13*f*. The position of the specific portion 13 can be selected as appropriate depending on the required characteristics.

When a certain heat dissipating characteristic is required, the lower end portion of the base portion 11A including the installation surface 15$h_g$ of the base portion 11A can be taken as an example of the position of the specific portion 13. In this case, since the specific portion 13 contains a large amount of metal such as iron, the thermal conductivity can be enhanced, thus making it easy to cool the core member 10A via the installation surface 15$h_g$. An example of the lower end portion of the base portion 11A including the installation surface 15$h_g$ is a region from the installation surface 15$h_g$ of the base portion 11A to about 1/7 of the height of the base portion 11A.

When a certain magnetic characteristic is required, the end portions of the projecting portions 12A including the interlinkage surfaces 15*i* (end surfaces facing other projecting portions 12A) of the projecting portions 12A can be taken as an example of the position of the specific portion 13. In this case, since the specific portion 13 contains a large amount of soft magnetic material such as iron, the magnetic permeability can be enhanced, and a leakage magnetic flux can be reduced to improve the magnetic characteristic. The "end portion of the projecting portion 12A including the interlinkage surface 15*i*" refers to a region in which the length from the interlinkage surface 15*i* of the projecting portion 12A is about 1/2 or less of the length of the projecting portion 12A, for example.

When both the heat dissipating characteristic and the magnetic characteristic are required, the lower end portion of the base portion 11A including the installation surface 15$h_g$ of the base portion 11A and the end portions of the projecting portions 12A including the interlinkage surfaces

15*i* of the projecting portions 12A can be taken as an example of the position of the specific portion 13. That is, when a plurality of characteristics are required, the specific portions 13 may be located at a plurality of positions depending on the required characteristics.

Here, the lower end portion of the base portion 11A including the installation surface 15$h_g$ of the base portion 11A (a region from the installation surface 15$h_g$ to about 1/7 of the above-mentioned height) and the end portions of the pair of projecting portions 12A including the interlinkage surfaces 15*i* of the projecting portions 12A (a region in which the length from the interlinkage surface 15*i* is about 1/2 or less of the above-mentioned length) are taken as the positions of the specific portions 13.

In order to meet the required characteristics, the specific portion 13 has a higher density than a region of an opposite surface 14 on a side opposite to the specific surface 13*f*. The "opposite surface 14" refers to a surface of the core member 10A located on a side opposite to the specific surface 13*f*. It is preferable that, out of intersecting surfaces that intersect orthogonal axes orthogonal to the specific surface 13*f* and the plane in which the specific surface 13*f* extends on a side opposite to the specific surface 13*f*, either the surface furthest away from the specific surface 13*f* and the plane in which it extends (surface intersecting the longest orthogonal axis) or the surface adjacent to the furthest surface is taken as the opposite surface 14. If the specific surface 13*f* and the plane in which it extends are constituted by a curved plane, normals of the specific surface 13*f* and the plane in which it extends are taken as the orthogonal axes. Although there are cases where the above-mentioned furthest surface and adjacent surface are oblique surfaces or curved surfaces that are not parallel to the specific surface 13*f* and cases where the furthest surface and adjacent surface are parallel surfaces that are parallel to the specific surface 13*f*, it is preferable that the above-mentioned furthest surface and adjacent surface, which are taken as the opposite surface 14, are parallel surfaces. The "region of the opposite surface 14" may refer to a region in which the distance from the surface including the opposite surface 14 is not more than 1/5 of the distance between the surface including the opposite surface 14 and the specific surface 13*f* (the interlinkage surface 15*i* or the installation surface 15$h_g$). It is particularly preferable that the specific portion 13 has a higher density than a region of a gate trace portion 16. The density of the specific portion 13 can be increased by providing the location of the gate at a predetermined position when molding the core member 10A. Details will be described later. It should be noted that the "region of the gate trace portion 16" may refer to a region in which the distance from the surface including the trace portion 16 (gate formation surface) is not more than 1/5 of the distance between the gate formation surface and the interlinkage surface 15*i* on a side opposite to the gate formation surface, the region including the trace portion 16 and having a height of 1/5 of the height of the gate formation surface. In this case, the width of the region of the trace portion 16 corresponds to the width of the trace portion 16.

Gate Trace Portion

The gate trace portion 16 is a portion corresponding to the gate for filling the cavity of the mold with the constituent materials (which will be described later) of the core member 10A when molding the core member 10A. The core member 10A can be manufactured by injection molding or metal injection molding (MIM). An additional portion including a portion corresponding to the gate is formed on the molded article produced by these techniques, and the gate trace portion 16 is formed by removing this additional portion. The additional portion may have a portion corresponding to a sprue in addition to the portion corresponding to the gate, and furthermore, the additional portion may also have a portion corresponding to a runner. The additional portion can be removed by being broken off, for example.

After the additional portion is removed, the portion corresponding to the trace portion 16 may be subjected to heat treatment. When the additional portion is removed, soft magnetic particles that are the constituent materials may be exposed locally from the trace portion 16. The resin near the surface of the trace portion 16 is fluidized by performing the heat treatment, thus making it possible to move the exposed soft magnetic particles from the surface of the resin to the inside thereof with the flow of the resin to embed the soft magnetic particles in the resin. It should be noted that FIG. 1 shows an emphasized projecting state of the trace portion 16 for illustrative reasons. The trace portion 16 may be flush with the region around the trace portion 16 or project farther than the region around the trace portion 16. Although the above-mentioned heat treatment is easily performed on a trace portion 16 that projects farther than the region around the trace portion 16, it is sufficient if the trace portion 16 projects in a very small projecting amount.

The portion in which the trace portion 16 is formed is determined depending on the position of the specific portion 13. The reason for this is that the trace portion 16 is dependent on the position of the gate, and providing the gate at a portion away from the specific portion 13 makes it possible to increase the density of the specific portion 13. A position that is located close to the opposite surface 14 rather than the specific surface 13*f* of the specific portion 13 on the outer surface of the core member 10A can be taken as an example of the portion in which the trace portion 16 is formed. "Located close to the opposite surface 14" refers to "located on the opposite surface 14" and "located at a position close to the opposite surface 14 rather than the specific surface 13*f*" in a case of being located on a surface other than the opposite surface 14. As the distance from the gate increases, the filling amount of the soft magnetic powder is increased, and thus the density is increased. Therefore, the density of the specific portion 13 can be made higher than the density of the region of the trace portion 16 by locating the portion in which the trace portion 16 is formed at a position located close to the opposite surface 14 rather than the specific surface 13*f*.

Case of Specific Portion Including Interlinkage Surface

When the specific portions 13 are located at the end portions of the projecting portions 12A and include the interlinkage surfaces 15*i* as the specific surface 13*f*, it is preferable that the portion in which the trace portion 16 is formed is located on at least one of the upper surface 15$u_g$, the installation surface 15$h_g$, and the outer end surface 15*o* (opposite surface 14 of the interlinkage surface 15*i*) of the base portion 11A, which are located on a side opposite to the interlinkage surfaces 15*i*. That is, it is preferable that the gate is provided such that the portion in which the trace portion 16 is formed when molding the core member 10A is located on at least one of the upper surface 15$u_g$, the installation surface 15$h_g$, and the outer end surface 15*o* of the base portion 11A. In this case, the densities of the specific portions 13, which are the end portions of the projecting portions 12A including the interlinkage surfaces 15*i*, can be increased. In particular, it is preferable that the portion in which the trace portion 16 is formed is located on the outer end surface 15*o* of the base portion 11A, and the planar portion of the outer end surface 15*o*, which is parallel to the interlinkage surface 15*i*, is particularly preferable. That is, it is preferable that the planar portion of the outer end surface 15*o* is taken as the opposite surface 14. The reason for this is that when the portion in which the trace portion 16 is formed is located on the outer end surface 15*o*, the core member 10A is easily assembled to the coil 2A, and the core member 10A is easily installed on a installation target.

When a plurality of specific portions 13 are provided, a position on the symmetry axis of these specific portions 13 can be taken as an example of the portion in which the trace portion 16 is formed. For example, the core member 10A shown in FIG. 1 includes the pair of projecting portions 12A, and the specific portions 13 are formed at the respective end portions of the projecting portions 12A. In this case, it is preferable that the portion in which the trace portion 16 is formed is located at substantially the center between the specific portions 13 on the outer end surface 15*o*. That is, it is preferable that the planar portion of the outer end surface 15*o* is taken as the opposite surface 14. In this case, the densities of the specific portions 13, which are symmetrically located, can be increased to substantially the same level.

Case of Specific Portion Including Installation Surface

When the specific portion 13 is located at the lower end portion of the base portion 11A and includes the installation surface 15$h_g$ as the specific surface 13*f*, it is preferable that the trace portion 16 is formed on at least one of the upper surface 15$u_g$ of the base portion 11A, which is located on a side opposite to the installation surface 15$h_g$, and the upper surface 15$u_g$ side (a position at which the distance from the installation surface 15$h_g$ is larger than ½ of the distance between the installation surface 15$h_g$ and the upper surface 15$u_g$) of the outer end surface 15*o* of the base portion 11A. In this case, the density of the specific portion 13, which is the lower end portion of the base portion 11A including the installation surface 15$h_g$, can be increased. When the trace portion 16 is formed on the upper surface 15$u_g$ side of the outer end surface 15*o* of the base portion 11A, the trace portion 16 is formed preferably at a position at which the distance from the installation surface 15$h_g$ is about ⅔ of the distance between the installation surface 15$h_g$ and the upper surface 15$u_g$, and particularly preferably at a position at which the distance from the installation surface 15$h_g$ is about ¾ of the distance between the installation surface 15$h_g$ and the upper surface 15$u_g$.

Case of Specific Portion Including Interlinkage Surface and Installation Surface When the specific portions 13 are located at the end portions of the projecting portions 12A and the lower end of the base portion 11A, and respectively include the interlinkage surfaces 15*i* and the installation surface 15$h_g$ as the specific surfaces 13*f*, the upper surface 15$u_g$ of the base portion 11A and the upper surface 15$u_g$ side of the outer end surface 15*o* of the base portion 11A, which are located on a side opposite to both the installation surface 15$h_g$ and the interlinkage surfaces 15*i*, are preferable as a portion in which the trace portion 16 is formed. In this case, the density of the lower end portion of the base portion 11A including the installation surface 15$h_g$ and the densities of the end portions of the projecting portions 12A including the interlinkage surfaces 15*i* can be increased. In particular, it is preferable to form the trace portion 16 on the upper surface 15$u_g$ side of the outer end surface 15*o* of the base portion 11A.

Here, the trace portion 16 is formed on the upper surface 15$u_g$ side (a position at which the distance from the installation surface 15$h_g$ is about 5/7 of the distance between the installation surface 15$h_g$ and the upper surface 15$u_g$) of the above-mentioned planar portion of the outer end surface 15*o* of the base portion 11A. The trace portion 16 has a projection shape extending over the entire length of the above-mentioned planar portion in the width direction. The "width direction" refers to a direction in which the two projecting portions 12A are arranged in parallel. Here, the trace portion 16 is located at the center of a region of the trace portion 16.

The trace portion 16 can be formed in a predetermined portion by providing the gate for filling the cavity of the mold with the constituent materials of the core member 10A at a predetermined position.

Although a single trace portion 16 is formed in FIG. 1, it is also possible to form a plurality of trace portions 16. When a plurality of trace portions 16 are formed, the trace portions 16 are formed so as to have a positional relationship in which they are away from the specific portion 13 by the same distance, for example. Although the trace portion 16 is formed in an elongated rectangular parallelepiped shape in FIG. 1, when a surface on which the trace portion 16 is formed has a curved shape, the trace portion 16 may be formed in an arc projection shape.

Constituent Materials

Soft Magnetic Powder

Examples of the soft magnetic powder include iron-based materials such as iron and iron alloys. Examples of iron alloys include a Fe—Si based alloy, a Fe—Al based alloy, a Fe—N based alloy, a Fe—Ni based alloy, a Fe—C based alloy, a Fe—B based alloy, a Fe—Co based alloy, a Fe—P based alloy, a Fe—Ni—Co based alloy, and a Fe—Al—Si based alloy. Other examples include non-metal materials such as ferrite. In particular, pure iron containing Fe in an amount of at least 99 mass % is preferable from the viewpoint of the magnetic permeability and the magnetic flux density.

The average particle diameter of the soft magnetic powder is preferably at least 1 μm and at most 1000 μm, and particularly preferably at least 10 μm and at most 500 μm. The soft magnetic powder may be obtained by mixing a plurality of types of powders having different particle diameters. When soft magnetic powder obtained by mixing fine powder and coarse powder is used in the materials of the core member, a low-loss reactor having a high saturation magnetic flux density can be easily obtained.

An example of the content of the soft magnetic powder in the composite material is at least 30 vol % and at most 85 vol % when the amount of the composite material is taken as 100 vol %. When the content of the soft magnetic powder is at least 30 vol %, the density of the specific portion 13 can be easily increased. Moreover, since the ratio of the magnetic component is sufficiently high, when the reactor 100A is built using the core member 10A, the saturation magnetic flux density can be easily increased. When the content of the soft magnetic powder is not more than 85 vol %, the fluidity of a mixture of the soft magnetic powder and a resin is excellent, and the productivity of the core member 10A is excellent. The content of the soft magnetic powder is preferably at least 50 vol %, more preferably at least 55 vol %, and particularly preferably at least 60 vol %, for example. In particular, when the content of the soft magnetic powder is at least 60 vol %, it is effective to mold the core member 10A using the gate provided at the position away from the specific portion 13 as described above. The reason for this is that when the content of the soft magnetic powder is high, the density is easily made non-uniform. The soft magnetic powder is preferably not more than 80 vol %, more preferably not more than 75 vol %, and particularly preferably not more than 70 vol %, for example.

Resin

Examples of the resin include thermosetting resins such as epoxy resin, phenol resin, silicone resin, and urethane resin, and thermoplastic resins such as polyphenylene sulfide (PPS) resin, polyamide resin (e.g., nylon 6, nylon 66, and nylon 9T), liquid crystal polymers (LCP), polyimide resin, and fluororesin. In addition, cold setting resins, bulk molding compounds (BMCs) obtained by mixing calcium carbonate or glass fiber to unsaturated polyester, millable-type silicone rubber, millable-type urethane rubber, and the like can also be used.

Other Considerations

The composite material may contain a powder (filler) made of a non-magnetic material such as ceramic including alumina, silica, and the like in addition to the soft magnetic powder and the resin. The filler contributes to the improvement of heat dissipating property. The content of the filler is preferably at least 0.2 mass % and at most 20 mass %, more preferably at least 0.3 mass % and at most 15 mass %, and particularly preferably at least 0.5 mass % and at most 10 mass %, when the amount of the composite material is taken as 100 mass %.

Manufacturing Method

The core member 10A can be manufactured by injection molding or MIM as described above. In the case of injection molding, the above-described soft magnetic powder and the above-described resin in a fluid state are mixed, and the mixture is poured into a molding mold having a predetermined shape and molded by applying predetermined pressure, and then the above-mentioned resin is cured (solidified). In the case of MIM as well, a molding mold is filled with the above-mentioned mixture, and then molding is performed.

Although not shown in the figures, this mold includes a specific inner peripheral surface for molding the specific surface 13*f*, which is at least one of the installation surface 15$h_g$ and the interlinkage surface 15*i*, out of the surfaces of the core member 10A, and an opposite inner peripheral surface for molding the opposite surface 14 on a side opposite to the specific surface 13*f*. The position of the gate in the mold is located close to the opposite inner peripheral surface rather than the specific inner peripheral surface, and can be selected as appropriate depending on a desired position of the specific portion 13 having a high density. A position corresponding to the outer end surface 15*o* connecting the installation surface 15$h_g$ and the opposite surface 14 (upper surface 15$u_g$), out of the surfaces of the core member 10A, can be taken as an example of the position of the gate. In this case, the core member 10A in which the specific surface 13*f* includes the installation surface 15$h_g$ can be easily manufactured, that is, a core member 10A can be easily manufactured in which the installation surface 15$h_g$ side contains a larger amount of the soft magnetic powder, the thermal conductivity of the installation surface 15$h_g$ can be enhanced, and the heat dissipating characteristic is excellent. A position corresponding to the opposite surface 14 (outer end surface 15*o*) of the interlinkage surface 15*i*, out of the surfaces of the core member 10A, can be taken as another example of the position of the gate. In this case, a core member 10A in which the specific surface 13*f* includes the interlinkage surface 15*i* can be manufactured, that is, a core member 10A can be manufactured in which the interlinkage surface 15*i* side contains a larger amount of the soft magnetic powder, a leakage magnetic flux can be reduced on the interlinkage surface 15*i*, and the magnetic characteristic is excellent.

A core member 10A that includes the base portion 11A and the pair of projecting portions 12A and has specific portions 13 including both the interlinkage surface 15*i* and the installation surfaces 15$h_g$ as in this embodiment is manufactured using a gate located at a position corresponding to the opposite surface 14 (upper surface 15$u_g$) side of the outer end surface 15*o* (planar portion) connecting the installation surface 15$h_g$ of the base portion 11A and the opposite surface 14, for example. In this case, it is preferable that the gate is located at a position corresponding to the opposite surface 14 side of the outer end surface 15*o* with respect to a position at which the distance from the installation surface 15$h_g$ is ⅔ of the distance between the installation surface 15$h_g$ and the opposite surface 14. In this case, the densities of the specific portions 13 can be more easily increased, and the core member 10A having an excellent magnetic characteristic and heat dissipating characteristic can be easily manufactured. Here, the gate is located at a position corresponding to a position on the outer end surface 15*o* at which the distance from the installation surface 15$h_g$ is about 5/7 of the distance between the installation surface 15$h_g$ and opposite surface 14.

Functions and Effects of Core Member

With the above-described core member 10A, the gate trace portion 16 is located close to the opposite surface 14 rather than the specific surface 13*f*, and thus the gate trace portion 16 is formed in a portion away from the specific portion 13. Therefore, the density of the specific portion 13 can be made higher than that of a region of the opposite surface 14 (region of the gate trace portion 16). Since the specific portion 13 includes the installation surface 15$h_g$ of the base portion 11A as the specific surface 13*f*, the installation surface 15$h_g$ side contains a larger amount of the soft magnetic powder, thus making it possible to enhance the thermal conductivity and improve the heat dissipating characteristic of the core member 10A via the installation surface 15$h_g$. Moreover, since the specific portion 13 includes the interlinkage surfaces 15*i* as the specific surfaces 13*f*, the interlinkage surface 15*i* side contains a larger amount of the soft magnetic powder, thus making it possible to enhance the magnetic permeability and reduce a leakage magnetic flux on the interlinkage surfaces 15*i* to improve the magnetic characteristic of the core member 10A. Accordingly, this core member 10A can favorably meet the required characteristics.

Reactor

The above-described core member 10A can be preferably used as the magnetic core 1A of the reactor 100A shown in FIG. 2. As described at the beginning of Embodiment 1, the reactor 100A includes the coil 2A including the pair of wound portions 20*a* and 20*b* and the magnetic core 1A constituted by the two core members 10A having the same shape. Although crosshatching indicating the specific portions 13 is omitted in FIG. 2, the specific portions 13 are located in the same portions as described above, that is, the specific portions 13 are located at the lower end portion of the base portion 11A including the installation surface 15$h_g$ and the end portions of the projecting portions 12A including the interlinkage surfaces 15*i*.

Coil

The two wound portions 20*a* and 20*b* are obtained by spirally winding the winding wire 20*w*, which is a single continuous wire having no joined portions, and coupled to each other via a coupling portion 20*r*. A coated wire in which the outer circumference of a conductor such as a flat wire or a round wire made of a conductive material such as copper, aluminum, or an alloy thereof is coated with an insulating coating made of an insulating material can be preferably used as the winding wire 20*w*. In this embodiment, a coated flat wire in which the conductor is a flat wire made of copper and the insulating coating is made of enamel (typically polyamideimide) is used. The wound portions 20*a* and 20*b* each are constituted by an edgewise coil obtained by winding this coated flat wire in an edgewise manner. The wound portions 20*a* and 20*b* are arranged in parallel (in a lateral direction) such that their axis directions are parallel to each other. The wound portions 20*a* and 20*b* have the same winding number and have a hollow tubular shape (quadrilateral tube). The end surfaces of the wound portions 20*a* and 20*b* have a shape obtained by rounding the corner portions of a rectangular frame. The coupling portion 20*r* is configured by bending a portion of the winding wire into a U shape at one end of the coil 2A (right side of the plane of FIG. 2). The upper surface of the coupling portion 20*r* is substantially flush with the upper surface of a turn forming portion of the coil 2A. Both end portions 20*e* of the winding wire 20*w* of the wound portion 20*a* and 20*b* extend from the turn forming portion. Both end portions 20*e* are connected to terminal members (not shown), and an external apparatus (not shown) such as a power source that supplies power to the coil 2A is connected via these terminal members.

Magnetic Core

The base portions 11A of the core members 10A are arranged so as to project from the coil 2A when the core members 10A are assembled to the coil 2A. The pairs of projecting portions 12A of the respective core members 10A are arranged inside the pair of wound portions 20*a* and 20*b* when the core members 10A are assembled to the coil 2A in the same manner. The annular magnetic core 1A is formed by coupling the interlinkage surfaces 15*i* of the projecting portions 12A of one of the core members 10A to the interlinkage surfaces 15*i* of the projecting portions 12A of the other of the core members 10A inside the wound portions 20*a* and 20*b*. With this coupling of the core members 10A, when the coil 2A is excited, a closed magnetic circuit is formed, and magnetic fluxes intersect the interlinkage surfaces 15*i* at a right angle. The core members 10A may be coupled without providing gap materials between the interlinkage surfaces 15*i* of the projecting portions 12A or by providing gap materials therebetween. An adhesive can be used to couple the core members 10A. Gaps (air gaps) may be provided between the core members 10A. In both cases, the specific portions 13 including the interlinkage surfaces 15*i* of the projecting portions 12A of the core members 10A have a high density, thus making it possible to reduce the leakage magnetic flux and improve the magnetic characteristic. Examples of the material of the gap material include non-magnetic materials such as alumina and unsaturated polyester, and mixtures containing a non-magnetic material such as a PPS resin and a magnetic material (e.g., iron powder). An example of the thickness of the gap material or the interval of the air gap is not more than 2.5 mm.

Heat Dissipating Plate

The reactor 100A can be provided with a heat dissipating plate 4 that releases heat of an assembly 110A. The heat dissipating plate 4 is constituted by a rectangular plate member having a size that allows the heat dissipating plate 4 to come into contact with the entire installation surface of the assembly 110A including the coil 2A and the magnetic core 1A. Therefore, in the reactor 100A, heat of the coil 2A and the magnetic core 1A can be transmitted to the installation target. In particular, the specific portions 13 including the installation surfaces 15$h_g$ of the base portions 11A of the core members 10A have a high density, and therefore, heat of the magnetic core 1A can be more easily transmitted to the installation target via the heat dissipating plate 4. It is preferable that flange portions 41 in which a through hole 41*h* through which a bolt (not shown) for fixing the heat dissipating plate 4 to the installation target is formed are provided at the four corners of the heat dissipating plate 4. The thickness of the heat dissipating plate 4 can be selected as appropriate, and an example thereof is about at least 2 mm and not more than 5 mm. Materials having an excellent thermal conductivity, such as metals including aluminum or an alloy thereof and non-metals including alumina, can be used as the constituent material of the heat dissipating plate 4. The heat dissipating plate 4 can be fixed to the assembly 110A with a joining layer 5, for example.

Joining Layer

The joining layer 5 is configured to come into contact with at least the installation surface of the coil 2A in the installation surface of the assembly 110A, for example. Providing the joining layer 5 makes it possible to firmly fix the coil 2A to the installation target or the above-described heat dissipating plate 4 in the case where the heat dissipating plate 4 is provided, thus making it possible to restrict the motion of the coil 2A, improve the heat dissipating property, and stabilize the fixation to the installation target or the heat dissipating plate 4. The joining layer 5 has a size that allows the joining layer 5 to come into contact with the entire installation surface of the assembly 110A. Materials that include an insulating resin, particularly a ceramic filler or the like, and have an excellent heat dissipating property (e.g., thermal conductivity of preferably at least 0.1 W/m-K, more preferably at least 1 W/m-K, and particularly preferably at least 2 W/m-K) are preferable as the constituent material of the joining layer 5. Specific examples of the resin include thermosetting resins such as epoxy resin, silicone resin, and unsaturated polyester, and thermoplastic resins such as PPS resin and LCP.

Functions and Effects

With the above-described reactor 100A, the core member 10A in which the end portions of the projecting portions 12A including the interlinkage surfaces 15*i* and the lower end portion of the base portion 11A including the installation surface 15$h_g$ have a high density is provided, and thus the magnetic characteristic and the heat dissipating characteristic are excellent.

Modified Example 1-1

Figure 3:
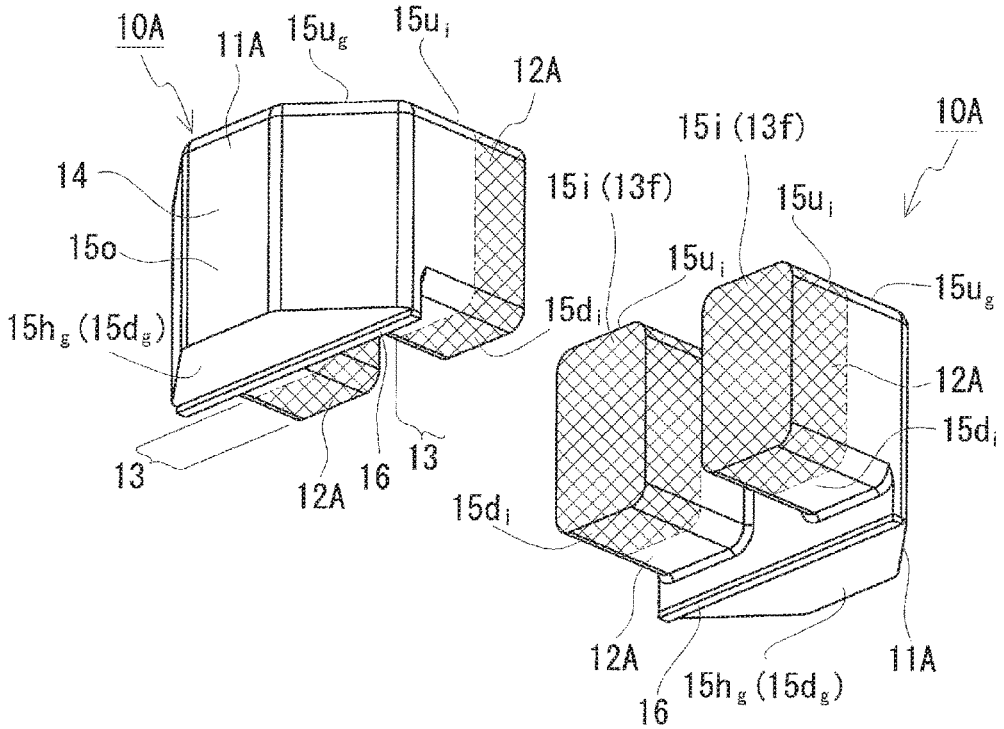
FIG. 3 shows diagrams of a core member according to Modified Example 1-1. The left diagram is a schematic perspective view as viewed from the outer end surface side, and the right diagram is a schematic perspective view as viewed from the interlinkage surface side.

A core member 10A in which, as shown in FIG. 3, the specific portions 13 are located at the end portions of the projecting portions 12A and include the interlinkage surfaces 15*i* as the specific surfaces 13*f*, and the trace portion 16 is located on the installation surface 15$h_g$ of the base portion 11A can be taken as Modified Example 1-1. Since the trace portion 16 is located on the installation surface 15$h_g$ of the base portion 11A, a core member 10A can be formed in which specific portions 13, which are the end portions of the projecting portions 12A including the interlinkage surfaces 15*i*, have a higher density than a region of the gate trace portion 16. The trace portion 16 has a projection shape that extends along the entire length of the long base of the trapezoidal installation surface 15$h_g$. In Modified Example 1-1, the "region of the trace portion 16" refers to a region in which the distance from the surface including the trace portion 16 (gate forming surface) is not more than ⅕ of the distance between the gate forming surface and the upper surface 15$u_g$ on a side opposite to the gate forming surface. That is, the region of the trace portion 16 includes the entire installation surface $15h_g$. This core member 10A has the same configuration as that of the core member 10A of Embodiment 1 except for the specific portions 13 and the portion in which the trace portion 16 is formed. This core member 10A is manufactured by using a gate located at a position corresponding to the installation surface $15h_g$ of the core member 10A, for example. Moreover, similarly, the reactor provided with the core members 10A has the same configuration as that of the reactor 100A of Embodiment 1 except for the specific portions 13 and the portion in which the trace portion 16 is formed in the core member 10A, and therefore, description and figures thereof are omitted. With the core member 10A of Modified Example 1-1, the trace portion 16 is formed on the installation surface $15h_g$ of the base portion 11A, thus making it possible to increase the densities of the specific portions 13, which are the end portions of the projecting portions 12A including the interlinkage surfaces 15*i*. Accordingly, the leakage magnetic flux can be reduced to improve the magnetic characteristic. The reactor 100A is provided with the core members 10A and thus has an excellent magnetic characteristic.

Embodiment 2

Figure 4:
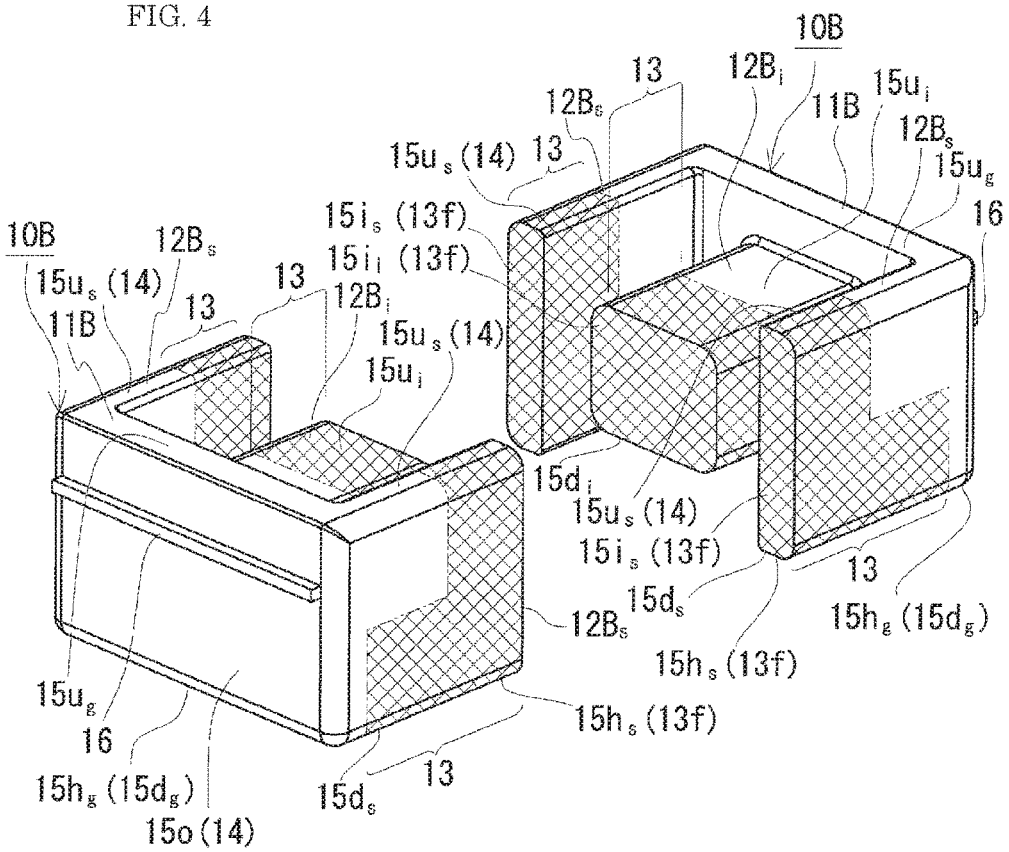
FIG. 4 shows diagrams of a core member according to Embodiment 2. The left diagram is a schematic perspective view as viewed from the outer end surface side, and the right diagram is a schematic perspective view as viewed from the interlinkage surface side.

In Embodiment 1 and Modified Example 1-1, a U-shaped core member 10A including the base portion 11A and the pair of projecting portions 12A, and a reactor 100A provided with such core members 10A have been described (FIGS. 1 to 3). In Embodiment 2, first, an E-shaped core member 10B including a base portion 11B, an inner projecting portion $12B_i$, and a pair of outer projecting portions $12B_s$ will be described with reference to mainly FIG. 4. Thereafter, a reactor 100B provided with the core members 10B will be described with reference to FIG. 5. In the following description, configurations that are different from those in Embodiment 1 will be mainly described, and description of configurations and effects similar to those in Embodiment 1 will be omitted. The same applies to Embodiment 3, which will be described later.

Core Member

Overall Configuration

Figure 5:
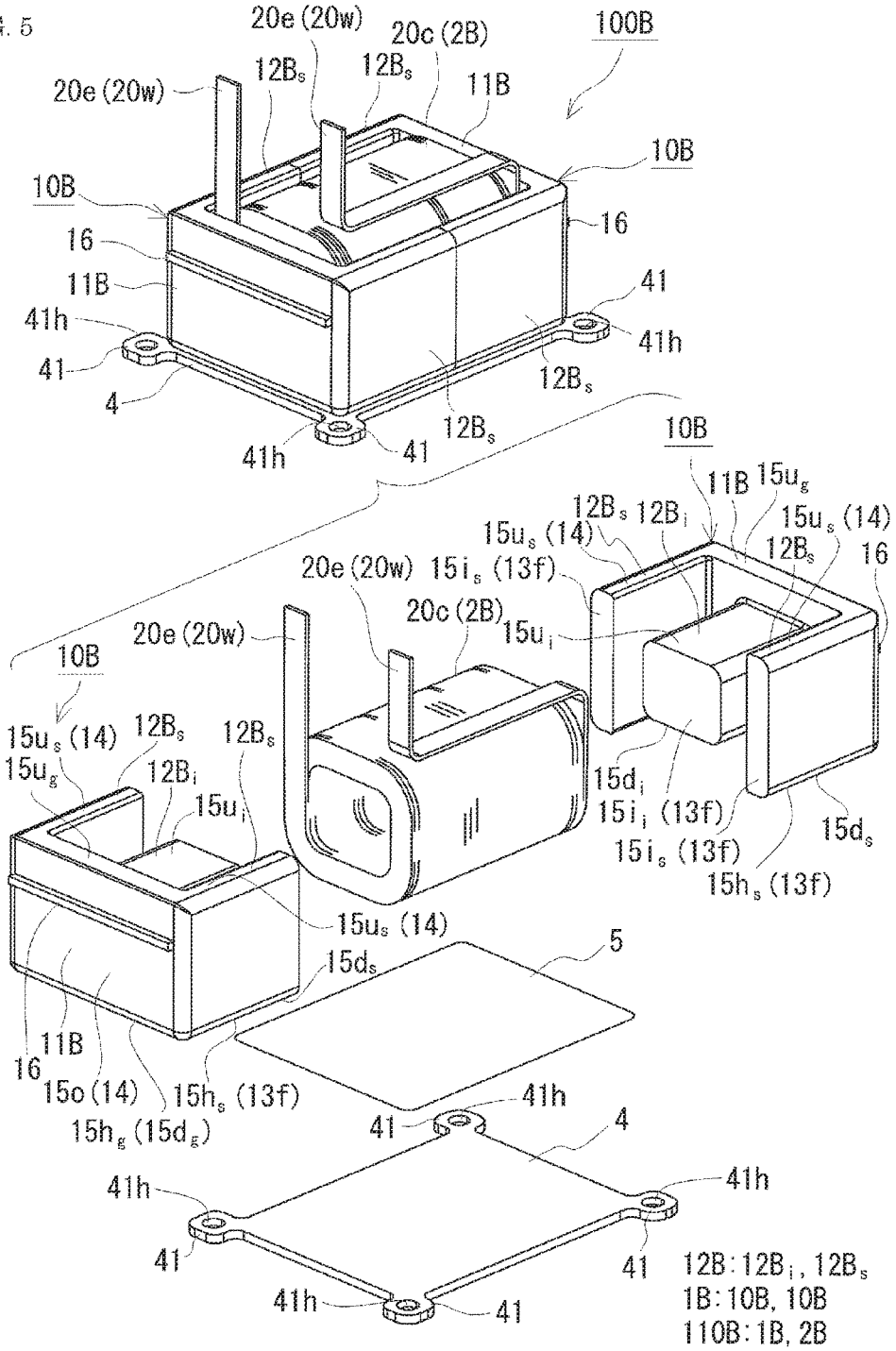
FIG. 5 shows diagrams of a reactor according to Embodiment 2. The upper diagram is a schematic perspective view, and the lower diagram is an exploded perspective view.

When the core member 10B is assembled to a coil 2B (FIG. 5), the base portion 11B projects from the end surface of the coil 2B similarly to the base portion 11A of Embodiment 1. The base portion 11B includes the lower surface $15d_g$, the upper surface $15u_g$, and the outer end surface 15*o* connecting the lower surface $15d_g$ and the upper surface $15u_g$. The outer end surface 15*o* includes a planar portion that is parallel to an inner interlinkage surface $15i_i$ (described later) of the inner projecting portion $12B_i$. The base portion 11B has a thin prismatic shape. The inner projecting portion $12B_i$ projects from the base portion 11B in a direction parallel to the lower surface $15d_g$ and in a direction away from the outer end surface 15*o* and are inserted into the coil 2B when the core member 10B is assembled to the coil 2B. The inner projecting portion $12B_i$ includes the inner interlinkage surface $15i_i$, which is on a side opposite to the outer end surface 15*o* of the base portion 11B and which is intersected by a magnetic flux excited by the coil 2B at a right angle. The inner projecting portion $12B_i$ has a rectangular parallelepiped shape, and their corner portions are rounded off so as to fit the inner peripheral surface of a wound portion 20*c* (FIG. 5). The outer projecting portions $12B_s$ project from the base portion 11B in the direction parallel to the lower surface $15d_g$ on the outer periphery of the coil 2B while the inner projecting portion $12B_i$ is located between the outer projecting portions $12B_s$. The outer projecting portions $12B_s$ each include an outer interlinkage surface $15i_s$, which is on a side opposite to the outer end surface 15*o* of the base portion 11B and which is intersected by a magnetic flux excited by the coil 2B at a right angle, and a lower surface $15d_s$. The outer projecting portion $12B_s$ has a thin prismatic shape.

The upper surface $15u_g$ of the base portion 11B is flush with upper surfaces $15u_s$ of the outer projecting portions $12B_s$, and the lower surface $15d_g$ of the base portion 11B is flush with the lower surfaces $15d_s$ of the outer projecting portions $12B_s$. These upper surfaces $15u_g$ and $15u_s$ are higher than the upper surface $15u_i$ of the inner projecting portion $12B_i$, and these lower surfaces $15d_g$ and $15d_s$ are lower than the lower surface $15d_i$ of the inner projecting portion $12B_i$. When the core member 10B is assembled to the coil 2B, the lower surface $15d_g$ of the base portion 11B and the lower surfaces $15d_s$ of the outer projecting portions $12B_s$ are flush with the lower surface of the coil 2B. That is, the surface of the core member 10B on the installation target side is constituted by the lower surface $15d_g$ of the base portion 11B and the lower surfaces $15d_s$ of the pair of outer projecting portions $12B_s$, and the lower surface $15d_g$ and the lower surfaces $15d_s$ form the installation surface $15h_g$ and installation surfaces $15h_s$ serving as a heat dissipating path of the core member 10B. The lengths of the outer projecting portions $12B_s$ (lengths from the base portion 11B in the projecting direction) are about half of the length of the wound portion 20*c*, and the length of the inner projecting portion $12B_i$ is slightly shorter than the outer projecting portions $12B_s$.

Specific Portion and Gate Trace Portion

Similarly to Embodiment 1, examples of the position at which the specific portion 13 is located include the lower end portion of the base portion 11B including the installation surface $15h_g$ of the base portion 11B, the lower end portions of the outer projecting portions $12B_s$ including the installation surfaces $15h_s$ of the outer projecting portions $12B_s$, the end portion of the inner projecting portion $12B_i$ including the inner interlinkage surface $15i_i$, and the end portions of the outer projecting portions $12B_s$ including the outer interlinkage surfaces $15i_s$. Here, the end portion of the inner projecting portion $12B_i$ including the inner interlinkage surface $15i_i$, the end portions of the outer projecting portions $12B_s$ including the outer interlinkage surfaces $15i_s$, and the lower end portions of the outer projecting portions $12B_s$ including the installation surfaces $15h_s$ of the outer projecting portion $12B_s$ are taken as the positions of the specific portions 13. The "end portion of the inner projecting portion $12B_i$" refers to a region in which the length from the inner interlinkage surface $15i_i$ is not more than about ½ of the length of the inner projecting portion $12B_i$. The "end portion of the outer projecting portion $12B_s$" refers to a region in which the length from the outer interlinkage surface $15i_s$ is not more than about ½ of the length of the outer projecting portion $12B_s$. The "lower end portion of the outer projecting portion $12B_s$" refers to a region from the installation surface $15h_s$ to about ½ of the height of the outer projecting portion $12B_s$. Examples of the portion in which the trace portion 16 is formed include the upper surface $15u_g$ of the base portion 11B, the lower surface $15d_g$ of the base portion 11B, and the outer end surface 15*o* of the base portion 11B. Here, the trace portion 16 is formed on the upper surface $15u_g$ side (a position at which the distance from the installation surface $15h_g$ is about 5/7 of the distance between the installation surface $15h_g$ and the upper surface $15u_g$) of the outer end surface 15*o* of the base portion 11B. This makes it possible to increase the density of the above-mentioned specific portion 13. The trace portion 16 has a projection shape extending over the entire length of the outer end surface 15*o* of the base portion 11B in the width direction. The "width direction" refers to a direction in which the two outer projecting portion 12$B_s$ are arranged in parallel. The core member 10B is manufactured using a gate located at a position corresponding to a portion close to the opposite surface 14 (upper surface 15$u_g$) on a side opposite to the installation surface 15$h_g$ on the outer end surface 15*o* of the base portion 11B, for example. Similarly to the manufacturing of the core member 10A of Embodiment 1, it is preferable that the gate is located at a position corresponding to the opposite surface 14 side of the outer end surface 15*o* with respect to a position at which the distance from the installation surface 15$h_g$ is ⅔ of the distance between the installation surface 15$h_g$ and the opposite surface 14. Here, the gate is located at a position corresponding to a position on the outer end surface 15*o* at which the distance from the installation surface 15$h_g$ is about 5/7 of the distance between the installation surface 15$h_g$ and opposite surface 14.

Reactor

A reactor 100B includes an assembly 110B obtained by assembling the coil 2B including the single wound portion 20*c* and a magnetic core 1B constituted by the two core members 10B having the same shape.

Coil

The wound portion 20*c* is configured by spirally winding the winding wire 20*w*, which is a single continuous wire having no joined portions. Both end portions 20*e* of the winding wire 20*w* are arranged on one end side of the coil 2B. Specifically, one of the end portions 20*e* of the winding wire 20*w* is drawn out in the radial direction of the coil 2B on one end side of the coil 2B, and the other of the end portions 20*e* of the winding wire 20*w* is bent so as to extend toward the one end side from the other end side of the coil 2B and further bent on the one end side so as to be drawn out in the radial direction of the coil. Since both of the end portions 20*e* of the winding wire 20*w* are arranged on the one end side of the coil 2B, a terminal member or the like can be easily attached thereto.

Magnetic Core

Similarly to the core member 10A of Embodiment 1, the base portions 11B of the core members 10B are arranged so as to project from the end surfaces of the coil 2B when the core members 10B are assembled to the coil 2B. The inner projecting portions 12$B_i$ of the core members 10B are arranged inside the wound portion 20*c*, and the outer projecting portions 12$B_s$ of the core members 10B are arranged on the outer periphery of the wound portion 20*c*. The core members 10B can be coupled to each other by connecting the outer interlinkage surfaces 15$i_s$ of the outer projecting portions 12$B_s$ to each other using an adhesive. At this time, air gaps are formed between the inner projecting portions 12$B_i$.

With the core member 10B of Embodiment 2, the trace portion 16 is formed on the upper surface 15$u_g$ side of the outer end surface 15*o* of the base portion 11B, thus making it possible to increase the density of the specific portion 13 including the inner interlinkage surface 15$i_i$ and the densities of the specific portions 13 including the outer interlinkage surfaces 15$i_s$. Therefore, the magnetic characteristic can be improved by reducing the leakage magnetic flux. Moreover, the densities of the specific portions 13 including the installation surfaces 15$h_s$ of the outer projecting portions 12$B_s$ can be increased. Therefore, the heat dissipating characteristic can be improved. The reactor 100B is provided with the core members 10B and thus has an excellent magnetic characteristic and heat dissipating characteristic.

Embodiment 3

Figure 6:
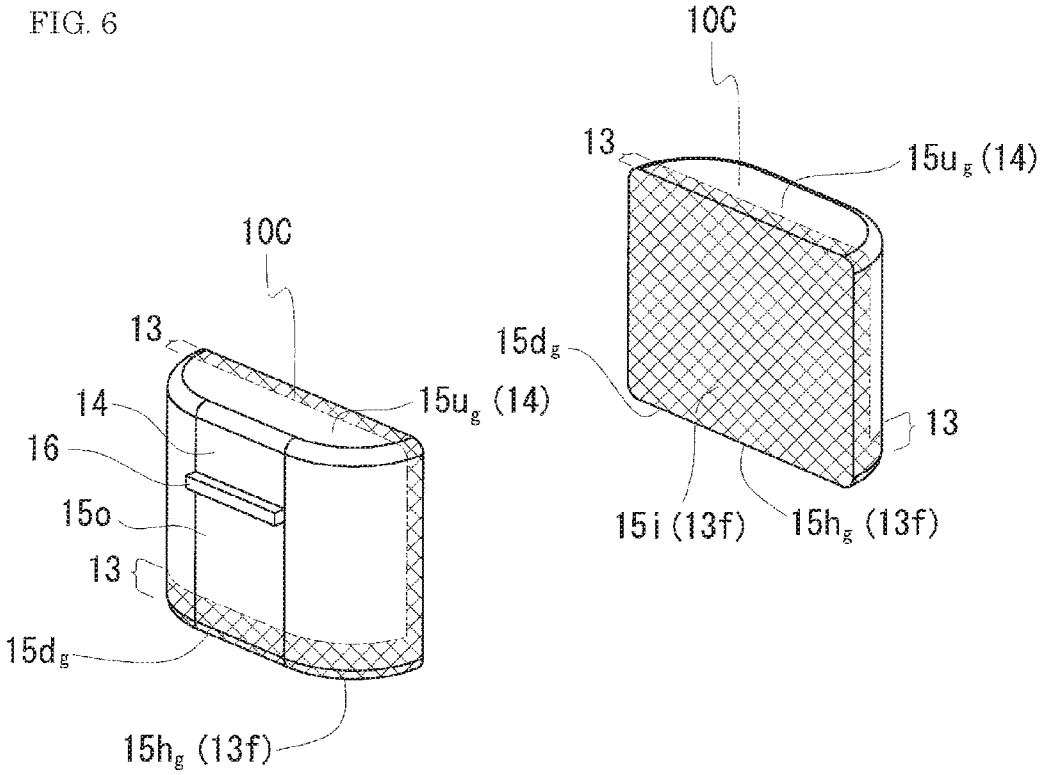
FIG. 6 shows diagrams of a core member according to Embodiment 3. The left diagram is a schematic perspective view as viewed from the outer end surface side, and the right diagram is a schematic perspective view as viewed from the interlinkage surface side.
Figure 7:
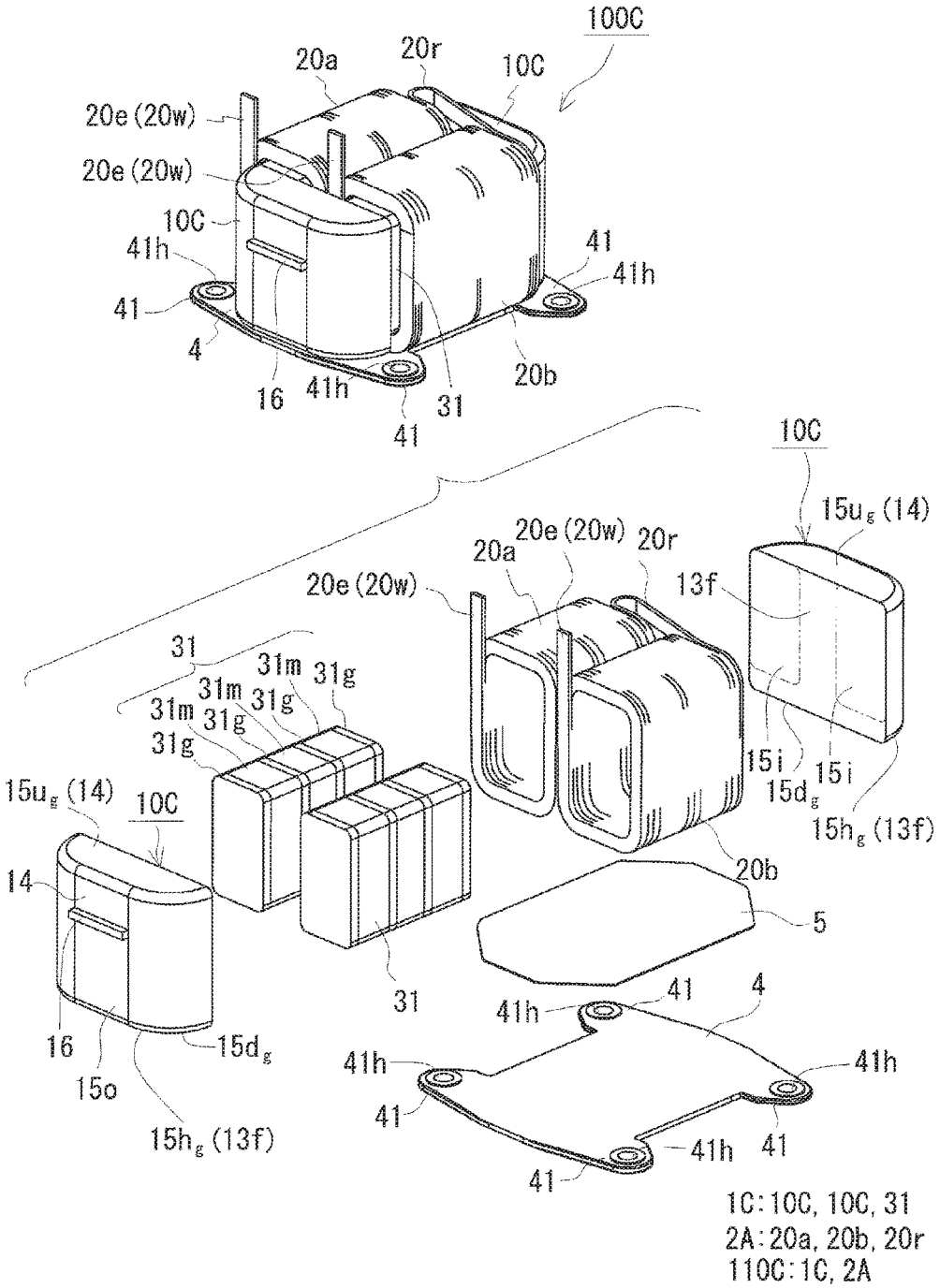
FIG. 7 shows diagrams of a reactor according to Embodiment 3. The upper diagram is a schematic perspective view, and the lower diagram is an exploded perspective view.

In Embodiment 1 and Modified Example 1-1, a U-shaped core member and a reactor provided with such U-shaped core members have been described, and in Embodiment 2, an E-shaped core member and a reactor provided with such E-shaped core member have been described. In Embodiment 3, first, a core member 10C having a columnar shape whose upper surface and lower surface have substantially a dome shape (modified trapezoidal shape with which the cross-sectional area decreases outward from the interlinkage surface) will be described with reference to mainly FIG. 6. Thereafter, a reactor 100C provided with the core members 10C will be described with reference to FIG. 7.

Core Member

Overall Configuration

When assembled to the coil 2A, the core member 10C projects (is exposed) from the end surface of the coil 2A. The core member 10C includes the installation surface 15$h_g$, the upper surface 15$u_g$, outer end surface 15*o* connecting the installation surface 15$h_g$ and the upper surface 15$u_g$, and an inner end surface including the interlinkage surface 15*i* which is intersected by a magnetic flux excited by the coil 2A. The outer end surface 15*o* includes a planar portion that is parallel to the interlinkage surface 15*i* and is located at the center, and curved portions that are arranged on both sides of the planar portion. When the core members 10C are assembled to other core members (inner core portions 31) and the coil 2A (FIG. 7), the upper surfaces 15$u_g$ of the core members 10C are flush with the upper surfaces of the inner core portions 31. The lower surfaces 15$d_g$ of the core members 10C are lower than the lower surfaces of the inner core portions 31 and flush with the lower surface of the coil 2A. That is, the surface of the core member 10C on the installation target side is constituted by the lower surface 15$d_g$, and this lower surface 15$d_g$ forms the installation surface 15$h_g$ serving as a heat dissipating path of the core member 10C.

Specific Portion and Gate Trace Portion

Examples of the position of the specific portion 13 include the lower end portions of the core members 10C including the installation surfaces 15$h_g$ and the end portions of the core members 10C including the interlinkage surfaces 15*i*. Here, the lower end portions and the end portions are taken as the positions of the specific portions 13. The "lower end portion of the core member 10C including the installation surface 15$h_g$" refers to a region from the installation surface 15$h_g$ to not more than about 1/10 of the height of the core member 10C. The "end portion of the core member 10C including the interlinkage surface 15*i*" refers to a region in which the distance from the interlinkage surface 15*i* is not more than about 1/20 of the distance between the interlinkage surface 15*i* and the opposite surface 14 (outer end surface 15*o*). Examples of the portion in which the gate trace portion 16 is formed include the upper surface 15$u_g$ of the core member 10C and the outer end surface 15*o* of the core member 10C. When the specific portions 13 are located at a plurality of positions such as both the lower end portion and the end portion as in this embodiment, it is preferable that the trace portion 16 is formed on the outer end surface 15*o* side of the upper surface 15$u_g$ or the upper surface 15$u_g$ side of the outer end surface 15*o*. Here, the gate trace portion 16 is formed on the upper surface 15$u_g$ side of the outer end surface 15*o* (planar portion) of the core member 10C. The trace portion 16 has a projection shape extending over the entire length of the above-mentioned planar portion in the width direction. The "width direction" refers to a direction in which the two inner core portions 31 are arranged in parallel. The core member 10C is manufactured using a gate located at a position corresponding to the upper surface $15u_g$ side of the outer end surface 15*o*, for example.

Reactor

The reactor 100C includes an assembly 110C obtained by assembling the coil 2A including the pair of wound portions 20*a* and 20*b*, which are the same as those in Embodiment 1, and a magnetic core 1C constituted by a plurality of core members including the above-mentioned core member 10C. Specifically, the magnetic core 1C includes a pair of core members (referred to as "inner core portions 31" hereinafter) that are arranged inside the wound portions 20*a* and 20*b*, and the pair of core members 10C on which the wound portions 20*a* and 20*b* are not arranged, the core members 10C projecting (being exposed) from the wound portions 20*a* and 20*b*.

Magnetic Core

The magnetic core 1C is assembled in an annular shape by joining four portions, that is, joining the interlinkage surface 15*i* (inner end surface) of one of the core members 10C to one end surfaces of the pair of inner core portions 31, and the interlinkage surface 15*i* of the other of the core members 10C to the other end surfaces of the pair of inner core portions 31. When the coil 2A is excited, these inner core portions 31 and the core members 10C form an annular closed magnetic circuit. The inner core portions 31 each have a columnar shape having an external shape that fits the inner peripheral shapes of the wound portions 20*a* and 20*b* (here, a shape obtained by rounding the corner portions of a rectangular parallelepiped (lower diagram in FIG. 7)). The core members 10C each have a columnar shape whose upper surface and lower surface have substantially a dome shape as described above.

The inner core portions 31 each are a laminated body in which a plurality of core pieces 31*m* and gap materials 31*g* made of a material having a magnetic permeability smaller than that of the core piece 31*m* are alternately arranged in a laminated manner. At least one of the core pieces 31*m* of the inner core portions 31 can be constituted by the above-described composite material.

With the core member 10C of Embodiment 3, the trace portion 16 is formed on the upper surface $15u_g$ side of the outer end surface 15*o* of the core member 10C, thus making it possible to increase the densities of the specific portion 13 including the interlinkage surfaces 15*i* and the densities of the specific portions 13 including the installation surface $15h_g$. Therefore, the magnetic characteristic and the heat dissipating property can be improved. The reactor 100C is provided with the core members 10C and thus has an excellent magnetic characteristic and heat dissipating characteristic.

Test Examples

A mixture containing soft magnetic powder and a resin was injected into a mold through a gate to manufacture a core member. The core member was divided into a plurality of portions, and the densities of the portions were measured.

Sample No. 1

Figure 8:
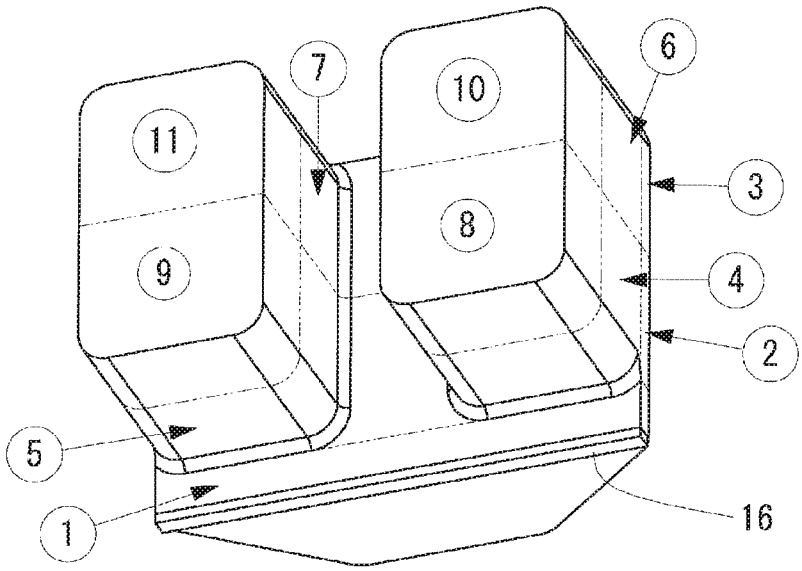
FIG. 8 is an explanatory diagram showing density measurement portions of a core member of Sample No. 1.

Three U-shaped core member samples including the base portion and the pair of projecting portions described in Embodiment 1 and Modified Example 1-1 above as shown in FIG. 8 were produced as a core member of Sample No. 1. A gate was provided such that the gate trace portion of the obtained core member was formed on the lower surface of the core member when the core member was produced.

Sample No. 2

Figure 9:
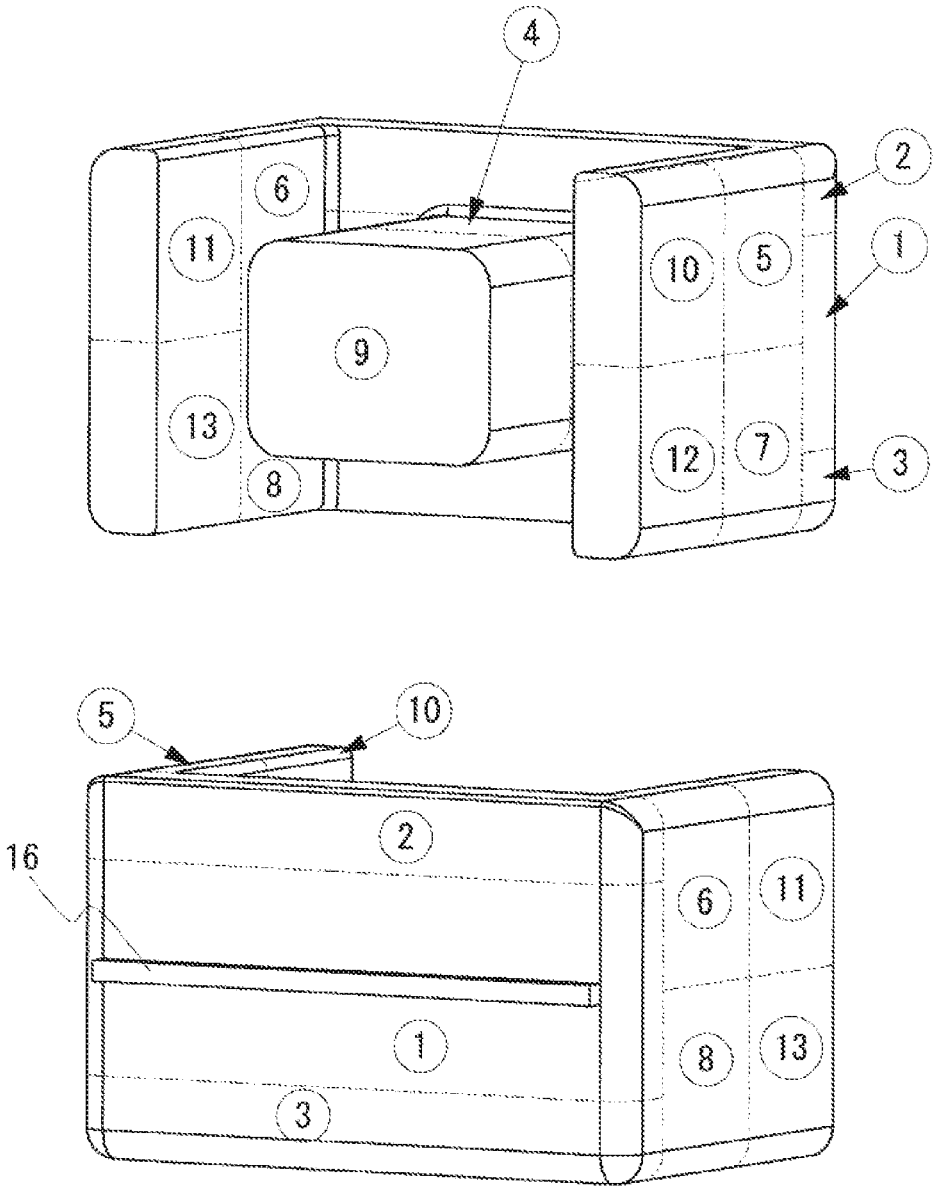
FIG. 9 is an explanatory diagram showing density measurement portions of a core member of Sample No. 2.

Three E-shaped core member samples including the base portion, the inner projecting portion, and the pair of outer projecting portions described in Embodiment 2 above as shown in FIG. 9 were produced as a core member of Sample No. 2. A gate was provided such that the gate trace portion of the obtained core member was formed at substantially the center of the outer end surface of the core member in the height direction when the core member was produced.

Density Measurement

The core member samples of Samples No. 1 and 2 each are divided into a plurality of portions, and the densities of the portions are measured. Long dashed double-short dashed lines in FIGS. 8 and 9 indicate cutting portions, and circled numbers indicate portion numbers.

As shown in FIG. 8, in Samples 1 to 3 of Sample No. 1, eleven divided pieces in total were produced by dividing the base portion into three portions in the height direction and dividing each of the projecting portions equally into two portions in the projecting direction and two portions in the height direction. A portion of the base portion that included the gate of the base portion and extended from the lower surface of the base portion to the lower surfaces of the projecting portions was taken as No. 1, a portion that was a half of the base portion excluding Portion No. 1 on the lower surface side in the height direction was taken as No. 2, and a portion that was a half on the upper surface side was taken as No. 3. Portions on the base portion side and the lower surface side of the projecting portions were respectively taken as No. 4 and 5, portions on the upper surface side with respect to Portions No. 4 and 5 were respectively taken as No. 6 and 7, portions on the interlinkage surface (end surface) side and the lower surface side of the projecting portions were respectively taken as No. 8 and 9, and portions on the upper surface side were respectively taken as No. 10 and 11.

As shown in FIG. 9, in Samples 1 to 3 of Sample No. 2, thirteen divided pieces in total were produced by dividing the base portion into three portions in the height direction, dividing the inner projecting portion equally into two portions in the projecting direction, and dividing each of the outer projecting portions equally into two portions in the projecting direction and two portions in the height direction. A portion that included the gate trace portion (central portion of the outer end surface in the height direction) and in which the length in the height direction was substantially the same as the length of the inner projecting portion was taken as No. 1, a portion on the upper surface side of the base portion with respect to Portion No. 1 was taken as No. 2, and a portion on the lower surface side of the base portion with respect to Portion No. 1 was taken as No. 3. A portion on the base portion side of the inner projecting portion was taken as No. 4, and a portion on the end surface side with respect to the base portion was taken as No. 9. Furthermore, portions on the base portion side and upper surface side of the outer projecting portions were respectively taken as No. 5 and 6, and portions on the lower surface side with respect to Portions No. 5 and 6 were respectively taken as No. 7 and 8. Portions on a side opposite to the base portion and on the upper surface side of the outer projecting portions were respectively taken as No. 10 and 11, and portions on the lower surface side with respect to Portions No. 10 and 11 were respectively taken as No. 12 and 13.

Figure 10:
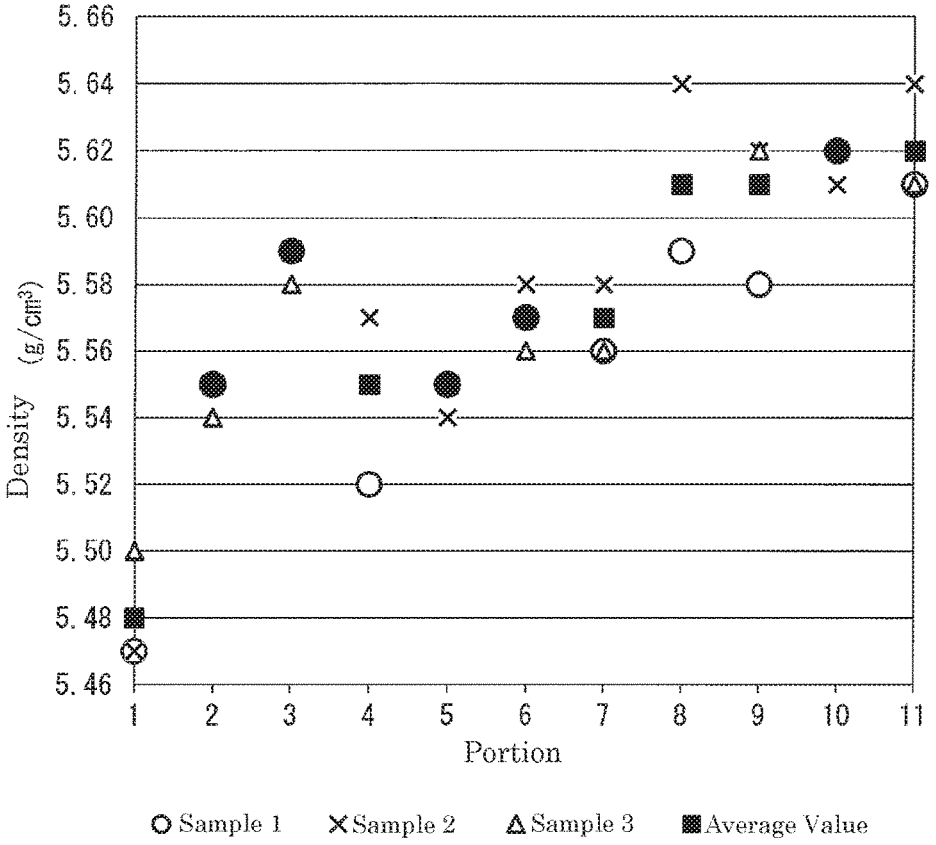
FIG. 10 is a graph showing the test result of Sample No. 1.
Figure 11:
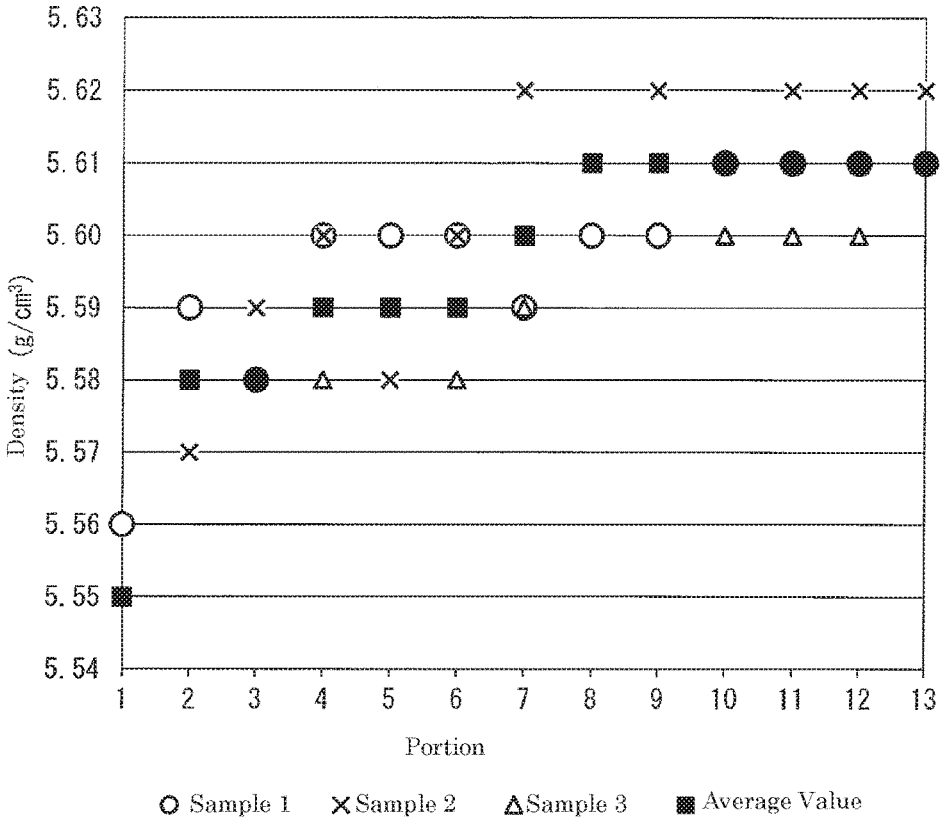
FIG. 11 is a graph showing the test result of Sample No. 2.

With regard to Samples No. 1 and 2, the densities (g/cm$^3$) of the portions of the produced samples, the average values (g/cm$^3$) of respective portions in all the samples, and increasing ratios (%) of the density average values of the portions other than Portion No. 1 (Portions No. 2 to 11 in Sample No. 1, and Portions No. 2 to 13 in Sample No. 2) relative to the density average value of Portion No. 1 were calculated. Table 1 shows the results of the above-mentioned densities, average values, and the increasing ratios in Sample No. 1, and Table 2 shows the results of the above-mentioned densities, average values, and the increasing ratios in Sample No. 2. In Tables 1 and 2, the third decimal places are rounded off. Moreover, FIG. 10 shows a graph illustrating the results of the above-mentioned densities and average values in Sample No. 1, and FIG. 11 shows a graph illustrating the results of the above-mentioned densities and average values in Sample No. 2. In FIGS. 10 and 11, the horizontal axes indicate the portion numbers, and the vertical axes indicate the densities (g/cm$^3$). In FIGS. 10 and 11, a white circle indicates the result of Sample 1, a cross indicates the result of Sample 2, a white triangle indicates the result of Sample 3, and a black square indicates the average value of the results of Samples 1 to 3.

TABLE 1

| | Density (g/cm$^3$) | | | | Increasing ratio |
|---|---|---|---|---|---|
| Portion No. | Sample 1 | Sample 2 | Sample 3 | Average value | relative to Portion 1 (%) |
| 1 | 5.47 | 5.47 | 5.50 | 5.48 | 0.00 |
| 2 | 5.55 | 5.55 | 5.54 | 5.55 | 1.20 |
| 3 | 5.59 | 5.59 | 5.58 | 5.59 | 1.92 |
| 4 | 5.52 | 5.57 | 5.55 | 5.55 | 1.24 |
| 5 | 5.55 | 5.54 | 5.55 | 5.55 | 1.19 |
| 6 | 5.57 | 5.58 | 5.56 | 5.57 | 1.62 |
| 7 | 5.56 | 5.58 | 5.56 | 5.57 | 1.55 |
| 8 | 5.59 | 5.64 | 5.61 | 5.61 | 2.43 |
| 9 | 5.58 | 5.62 | 5.62 | 5.61 | 2.28 |
| 10 | 5.62 | 5.61 | 5.62 | 5.62 | 2.46 |
| 11 | 5.61 | 5.64 | 5.61 | 5.62 | 2.52 |

TABLE 2

| | Density (g/cm$^3$) | | | | Increasing ratio |
|---|---|---|---|---|---|
| Portion No. | Sample 1 | Sample 2 | Sample 3 | Average value | relative to Portion 1 (%) |
| 1 | 5.56 | 5.55 | 5.55 | 5.55 | 0.00 |
| 2 | 5.59 | 5.57 | 5.58 | 5.58 | 0.41 |
| 3 | 5.58 | 5.59 | 5.58 | 5.58 | 0.52 |
| 4 | 5.60 | 5.60 | 5.58 | 5.59 | 0.68 |
| 5 | 5.60 | 5.58 | 5.59 | 5.59 | 0.68 |
| 6 | 5.60 | 5.60 | 5.58 | 5.59 | 0.70 |
| 7 | 5.59 | 5.62 | 5.59 | 5.60 | 0.79 |
| 8 | 5.60 | 5.61 | 5.61 | 5.61 | 0.91 |
| 9 | 5.60 | 5.62 | 5.61 | 5.61 | 0.95 |
| 10 | 5.61 | 5.61 | 5.60 | 5.61 | 0.95 |
| 11 | 5.61 | 5.62 | 5.60 | 5.61 | 1.02 |
| 12 | 5.61 | 5.62 | 5.60 | 5.61 | 0.96 |
| 13 | 5.61 | 5.62 | 5.61 | 5.61 | 1.07 |

As shown in Table 1 and FIG. 10, and Table 2 and FIG. 11, in both Sample No. 1 and Sample No. 2, the portions differed in density. It was found that, in Sample No. 1, the portions located away from the gate, such as Portions No. 8 to 11, tended to have a higher density than portions located near the gate, such as Portions No. 1, 2, 4, and 5. On the other hand, it was found that, in Sample No. 2 as well, portions located away from the gate, such as Portions No. 7 to 13, tended to have a higher density than portions located near the gate, such as Portions No. 1 to 3.

INDUSTRIAL APPLICABILITY

The core member according to the present invention can be favorably used in various types of converters such as vehicle-mounted converters (typically DC-DC converters) to be mounted in vehicles including hybrid cars, plug-in hybrid cars, electric cars, fuel cell cars, and the like, and converters for an air conditioner, and cores provided in reactors capable of being used in components of power conversion devices. The method for manufacturing a core member according to the present invention can be favorably used to manufacture the above-mentioned core members. The reactor according to the present invention can be favorably used in various types of converters such as vehicle-mounted converters (typically DC-DC converters) to be mounted in vehicles including hybrid cars, plug-in hybrid cars, electric cars, fuel cell cars, and the like, and converters for an air conditioner, and components of power conversion devices.

The invention claimed is:

1. A core member obtained by molding a mixture containing soft magnetic powder and a resin, the core member comprising:

a base portion and a pair of projecting portions spaced apart from each other and projecting from the base portion;

an installation surface disposed on a bottom portion of the base portion, the installation surface facing an object on which the core member is to be installed and an interlinkage surface disposed on an end of each of the projecting portions, the interlinkage surface being intersected by a magnetic flux excited by a coil; and wherein the installation surface and the interlinkage surface has a higher density than the base portion and the pair of projecting portions.

2. The core member according to claim 1, wherein the core member is molded by injecting the mixture into a mold through a gate, the core member includes a gate trace portion disposed on an outer surface of the base portion, and the installation surface and the interlinkage surface have a higher density than a region of the gate trace portion.

3. The core member according to claim 1, further comprising:

an inner projecting portion that includes an inner interlinkage surface the inner projecting portion projects from the base portion in a direction parallel to the installation surface and disposed between the pair of projecting portions, and is inserted into the coil.

4. The core member according to claim 2, comprising:

wherein the gate trace portion is formed on the opposite surface side of the base portion to a position at which a distance from the installation surface is ⅔ of a distance between the installation surface and a top surface of the base portion.

5. A reactor comprising:

a coil obtained by winding a winding wire; and a magnetic core in which the coil is arranged, wherein at least a portion of the magnetic core is constituted by the core member according to claim 1.

6. A method for manufacturing a core member, comprising:

a step of molding a core member by injecting a mixture containing soft magnetic powder and a resin into a mold through a gate and curing the resin, wherein the mold includes:

a specific inner peripheral surface for molding a specific surface including at least one of an installation surface facing an object on which the core member is to be installed and an interlinkage surface that is intersected by a magnetic flux excited by a coil, out of the surfaces of the core member; and an opposite inner peripheral surface for molding an opposite surface on a side opposite to the specific surface, wherein the gate is located close to the opposite inner peripheral surface rather than the specific inner peripheral surface in the mold.

7. The method for manufacturing a core member according to claim 6, wherein the core member includes the installation surface, an opposite surface of the installation surface, and an outer end surface connecting the installation surface and the opposite surface of the installation surface, and the gate is provided at a position corresponding to the outer end surface.

8. The method for manufacturing a core member according to claim 6, wherein the core member includes the interlinkage surface and an opposite surface of the interlinkage surface, and the gate is provided at a position corresponding to the opposite surface of the interlinkage surface.

9. The method for manufacturing a core member according claim 6, wherein the core member includes:

a base portion including the installation surface, an opposite surface of the installation surface, and the outer end surface connecting the installation surface and the opposite surface of the installation surface; and a pair of projecting portions that includes the interlinkage surface on a side opposite to the outer end surface, projects from the base portion in a direction parallel to the installation surface, and is inserted into the coil, wherein the gate is provided at a position corresponding to the opposite surface side of the outer end surface.

10. The method for manufacturing a core member according claim 6, wherein the core member includes:

a base portion including the installation surface, an opposite surface of the installation surface, and the outer end surface connecting the installation surface and the opposite surface of the installation surface;

an inner projecting portion that includes the interlinkage surface on a side opposite to the outer end surface, projects from the base portion in a direction parallel to the installation surface, and is inserted into the coil; and a pair of outer projecting portions that projects from the base portion in the direction parallel to the installation surface on an outer periphery of the coil while the inner projecting portion is located between the outer projecting portions, wherein the gate is provided at a position corresponding to the opposite surface side of the outer end surface.

11. The method for manufacturing a core member according to claim 6, wherein the core member includes the installation surface, the opposite surface of the installation surface, and the outer end surface connecting the installation surface and the opposite surface of the installation surface, and the gate is provided at a position corresponding to the opposite surface side of the outer end surface with respect to a position at which a distance from the installation surface is ⅔ of a distance between the installation surface and the opposite surface.

* * * * *